US005669638A

United States Patent [19]

Anderson et al.

[11] Patent Number: 5,669,638

[45] Date of Patent: Sep. 23, 1997

[54] FASTENING DEVICE

[75] Inventors: Glenn E. Anderson, Malvern, Pa.; Alan Mazurowski; Cuyler Hoen, both of Rensselear, N.Y.

[73] Assignee: Southco, Inc., Concordville, Pa.

[21] Appl. No.: 595,175

[22] Filed: Feb. 1, 1996

[51] Int. Cl.[6] ..... E05C 5/00

[52] U.S. Cl. ..... 292/111; 292/257

[58] Field of Search ..... 292/111, 257, 292/49

[56] References Cited

U.S. PATENT DOCUMENTS

| | | | |
|---|---|---|---|
| 1,880,928 | 10/1932 | Ekman . | |
| 1,935,226 | 11/1933 | Jensen | 292/257 |
| 2,324,356 | 7/1943 | Brown | 292/257 |
| 2,477,472 | 7/1949 | Wright . | |
| 2,820,995 | 1/1958 | Schlueter . | |
| 2,853,751 | 9/1958 | Schlueter . | |
| 2,853,752 | 9/1958 | Schlueter . | |
| 2,886,364 | 5/1959 | Smith . | |
| 3,030,137 | 4/1962 | Cheney . | |
| 3,150,893 | 9/1964 | Poe | 292/111 |
| 3,174,784 | 3/1965 | Swanson . | |
| 3,204,993 | 9/1965 | Swanson | 292/111 |
| 3,892,434 | 7/1975 | Caldwell . | |
| 3,918,751 | 11/1975 | Blake . | |
| 3,936,082 | 2/1976 | Swanson . | |
| 4,049,301 | 9/1977 | Schenk . | |
| 4,090,727 | 5/1978 | Busch et al. . | |
| 4,124,184 | 11/1978 | Juergens . | |
| 4,181,333 | 1/1980 | Stelma . | |
| 4,341,407 | 7/1982 | Zankich | 292/111 |
| 4,522,436 | 6/1985 | Hoen et al. . | |
| 4,560,190 | 12/1985 | Werner | 292/111 |
| 4,746,151 | 5/1988 | Hoen et al. . | |
| 4,758,031 | 7/1988 | Wolf | 292/111 |
| 4,958,865 | 9/1990 | Cheng | 292/111 |
| 5,213,381 | 5/1993 | Anderson | 292/111 |

FOREIGN PATENT DOCUMENTS

| | | |
|---|---|---|
| 674923 | 11/1963 | Canada . |
| 2114104 | 10/1972 | Germany . |

*Primary Examiner*—Rodney M. Lindsey
*Attorney, Agent, or Firm*—Paul & Paul

[57] ABSTRACT

The present invention provides a fastener adapted to be secured to a first member for fastening a keeper secured to a second member. The fastener comprises a base member, a sleeve member connected to the base member, and a slide member received within the sleeve member to be extended or withdrawn. The sleeve member is included with an opening into which a cam mechanism is received for rotatable movement. A cam member is also provided extending from the cam mechanism and into a cam opening provided in the slide member. The fastener also includes a turning member which is adapted to rotate the cam mechanism so as to move the cam member within the cam opening in order to extend or withdrawal the slide member. The fastener may also include a biasing member confined within the base member in order to bias the sleeve member relative to the base member as the slide member is fastened with the keeper. In addition, the fastener may be adapted for increasing the amount of extension or withdrawal of the slide member. Further, the fastener may be adapted for retaining the cam mechanism within the opening provided in the sleeve member. The fastener may also include a cam mechanism of increased strength.

39 Claims, 17 Drawing Sheets

94
72
92
10
22
64
66
84
70
82
68
76
78
74
58
60
16
56
62
54
52
42
50
14
38
40
44
34
104
20
98
30
24
32
26
24
28
12

72A
92A
90B
43A
10
22
86A
88A
70A
84A
82A
90A
16
68A
78A
76A
74A
14
34
20
12

172
110
192
122
116
170
182
156
114
150
138
140
168
177
174
175
120
134
112

710
518
522
518
516
518
714
744
520
715
534
717
720
730
720
712
732

FASTENING DEVICE

FIELD OF THE INVENTION

The present invention relates to fasteners in general and more particularly to fasteners that are used to pull and secure two members together.

BACKGROUND OF THE INVENTION

There are a number of fasteners commercially available which are operable to pull and secure together two members, for example two panels. The panels may be portable enclosures, packing cases, instrument cases, transit cases, folding table, trunks, and other packages, to name a few. Generally, such fasteners consist of two separate elements, each of which is attached to one of the panels. For instance, one panel may be a container lid and the other panel the container body. Such fasteners may be used to obtain a tight seal and may be used to compress a gasket positioned between the two panels. Examples of such fasteners are disclosed in U.S. Pat. Nos. 2,820,995, 2,853,751, 2,853,752, 4,090,727, and 4,746,151, each incorporated by reference herein.

One particular problem observed with prior an fasteners is that many are large in configuration which severely limit the types of applications in which such fasteners can be used. For instance, such fasteners are not suitable for use in applications where there is only a limited area in which the fastener can be mounted. Further, many such fasteners are often times considered too "industrial looking" for use in applications where appearance of the fastener is an important consideration. For example, one such fastener is shown in U.S. Pat. No. 2,820,995 to Earnest Schleuter which describes a spring loaded link lock® fastener comprising a hasp member 36 mounted on a spring member 31, which in turn is mounted to a bracket 16 secured to first panel 10. A slide plate member 42 is received within the hasp member 36 which is extended or withdrawn by rotation of a bolt 60, in order to engage a keeper 48 secured to a second panel 12 for latching together of the respective panels. The spring member 31 in addition to fastening the hasp member 36 to the bracket 16 also provides additional yielding force which operates to secure the panels in the latched position.

Another problem observed in prior art fasteners is that the amount of extension or "grip range" of the fastener is limited. For example, in the U.S. Pat. No. 2,820,995 the hasp member 36 is adapted to be extended a specific amount by rotation of the bolt 60 for engaging the keeper 48. Similarly, in U.S. Pat. No. 4,090,727 to Kieran Busch and Cuyler Hoen and reassigned to the assignee of the present invention, a hasp or slide member 40 is provided which is extended a specific amount through rotation of three interlocking disc members 50, 55, and 61 for engaging a keeper 10. However, in many applications, the amount of extension or "grip range" provided by the hasp or slide member is not sufficient. For instance, one example is in applications where thicker gaskets are desired to be utilized which would position the keeper beyond the "grip range" of the latch.

Still another problem identified in the prior art is related to the mechanical strength of the device. For example, in U.S. Pat. No. 4,090,727, as noted above the slide member 40 during operation is displaced through rotation of the three disc members 50, 55, and 61. In this configuration, the disc member 50 is positioned seated within an opening 37 of a sleeve member 31 and is connected to the remaining two disc members 55, 61 by a rivet 70. In addition, the disc members 50 and 55 are each provided with a boss extending from their upper surfaces and which extend into a corresponding opening in the disc members 55 and 61, respectively, for positioning the disc members relative to each other. In operation the three disc members are rotatable about the rivet 70 in order to extend or withdrawal the slide member 40. One disadvantage is that the disc member 50 may be dislodged from its seated position within the opening 37 of the sleeve member 31, reducing the overall strength of the latch and possibly leading to damage of the various components or complete failure of the device. Further, another drawback is that the rotation of the disc members in order to operate the latch can become more difficult due to increased frictional resistance. Another disadvantage is that the lower disc member 50 and middle disc member 55 may separate and release the connection between the boss and corresponding opening between the disc members also resulting in latch failure. Generally, such problems in latch operation can occur from excessive loads exerted on the device, for example, which can occur during operation of the device as the disc members are rotated or when under load, or from contact directly on the latch itself.

The present invention has been developed in view of the foregoing and to overcome the deficiencies of the prior art.

SUMMARY OF THE INVENTION

The present invention provides a fastener adapted to be secured to a first member for fastening a keeper secured to a second member. In accordance with the present invention, the fastener comprises a base member, a sleeve member connected to the base member, and a slide member received within the sleeve member to be extended or withdrawn. The sleeve member is included with an opening into which a cam means is received for rotatable movement. A cam member is also provided extending from the cam means and into a cam opening provided in the slide member. The fastener also includes a turning means which is adapted to rotate the cam means so as to move the cam member within the cam opening in order to extend or withdrawal the slide member. The fastener may also include a biasing means confined within the base member in order to bias the sleeve member relative to the base member as the slide member is fastened with the keeper. In addition, the fastener may include means for increasing the amount of extension or withdrawal of the slide member. Further, the fastener may include means for retaining the cam means within the opening provided in the sleeve member. The fastener may also include a cam means of increased strength.

It is an object of the present invention to provide a novel fastener.

It is another object of the present invention to provide a fastener of compact design and which provides a sufficient amount of force in order to secure two panels in a latched position.

It is another object of the present invention to provide a fastener having increased "grip range" of its slide member.

It is still another object of the present invention to provide a fastener which is adapted to retain a cam mechanism in a seated position within a sleeve member during operation.

It is still another object of the present invention to provide a fastener having a cam mechanism of increased strength and durability.

These and other objects of the present invention will be more readily apparent from the following description and attached drawings.

DETAILED DESCRIPTION OF THE PREFERRED EMBODIMENTS

Figure 1:
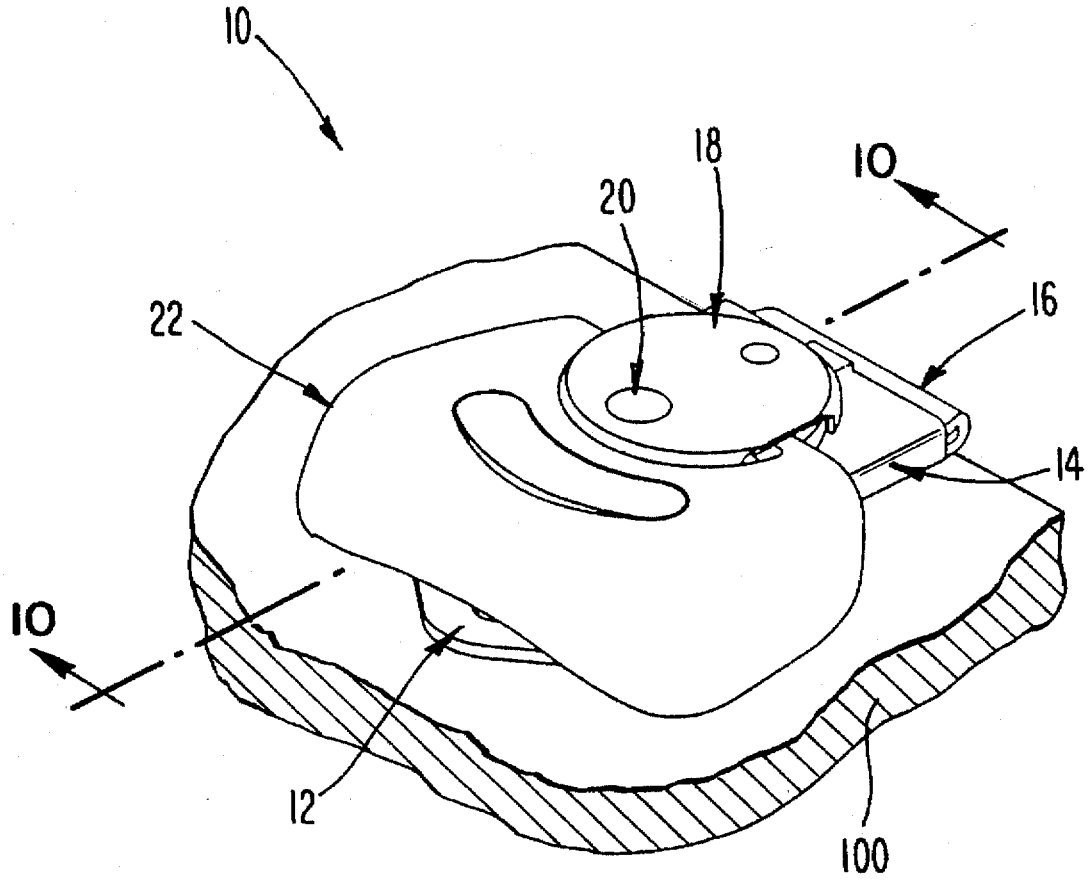
FIG. 1 is a perspective view of a fastener in accordance with an embodiment of the present invention, shown mounted to a portion of a panel.

Referring now to the drawings in detail, wherein like reference numerals indicate like elements throughout the several views, there is shown in FIG. 1 a perspective view of a fastener in accordance with one embodiment of the present invention. The fastener 10 as shown includes, as portions thereof, a base member 12, a sleeve member 14, a slide member 16, a cam means 18, a cam member 20, and a turning means 22. The portions of the fastener 10 will be described in more detail in the following paragraphs.

As shown in FIG. 1, the fastener 10 is adapted to be connected to a first member 100. As indicated earlier, the first member can comprise a panel, closure or the like, such as the body portion of a container. The attachment of the fastener 10 to the first member 100 is accomplished by the base member 12. The base member 12 is attached to the first member 100 by means of screws or other suitable fastener, such as an adhesive. As best seen in the exploded view of FIG. 2, in the present embodiment, the base member 12 includes a bottom plate having holes 24 therethrough for attachment to the first member 100 by a pair of screws (not shown). The base member 12 may also have opposing side portions 26 and 28 at respective opposite sides of the bottom portion of the base member 12. The side portions 26 and 28 each have a hole therethrough, respectively 30 and 32, through which an elongated pin 34 is secured. The pin 34 in the present embodiment has a head at one of its ends, positioned on the outside of the side portion 26, and a peened-over portion, positioned on the outside of the opposite side portion 28.

The sleeve member 14 has, as integral portions thereof, an upper surface 38, a lower surface 40, a central portion 42 and a connecting portion which, in the present embodiment, comprises a turned-over elongated tubular portion 44. The shank of the pin 34 fits within the tubular portion 44 so that the sleeve member 14 is hinged and rotatable about the pin 34. Hinge means comprising the pin 34, and tubular portion 44 permits pivotal motion of the sleeve member 14 relative to the base member 12.

Figure 2:
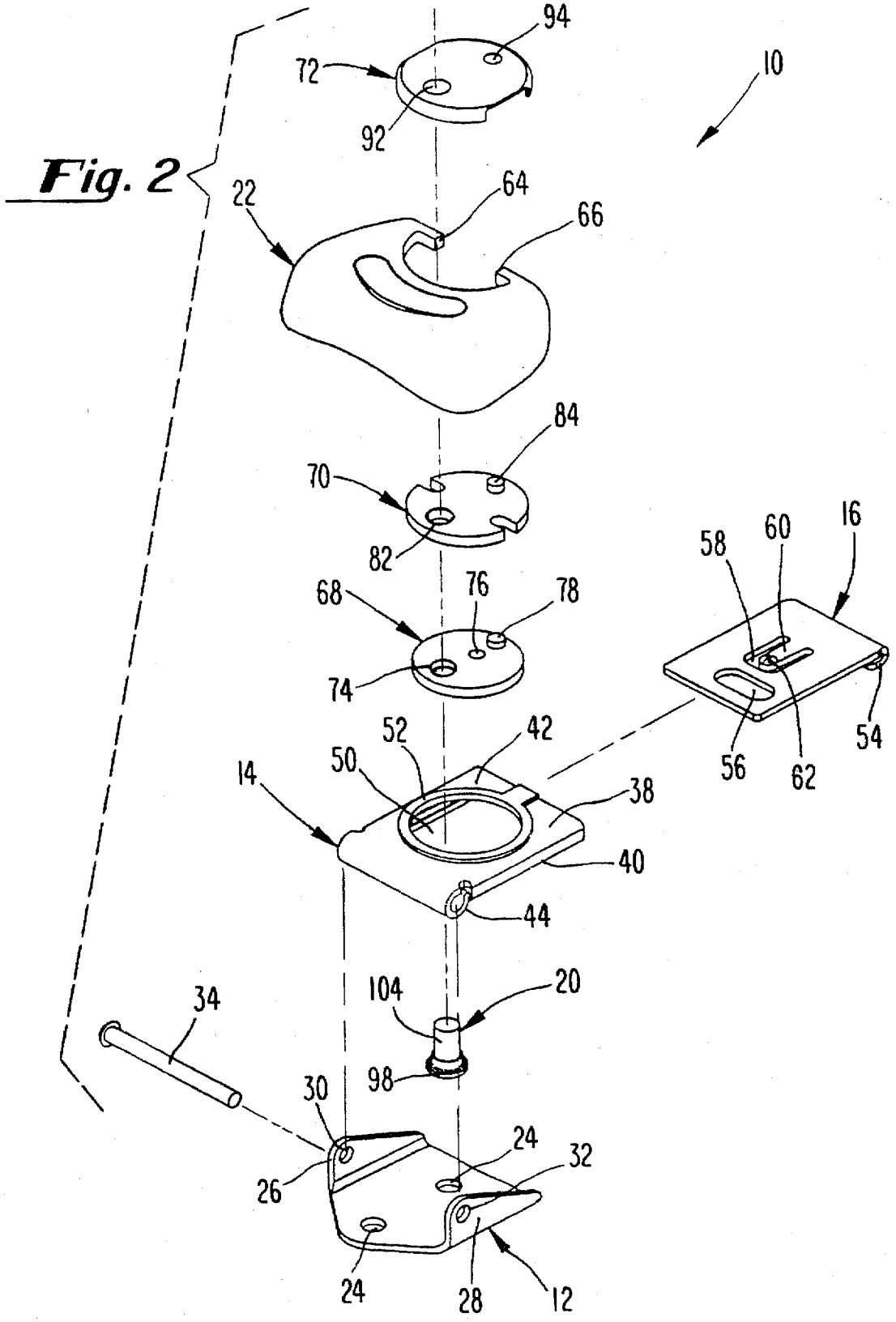
FIG. 2 is an exploded view of the fastener shown in FIG. 1.
Figure 3:
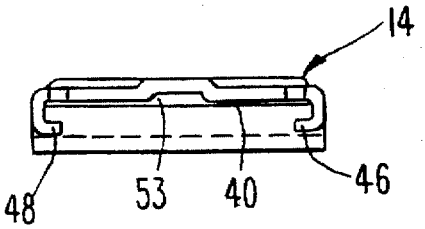
FIG. 3 is a front view of a sleeve member shown in FIG. 2.

As best illustrated in the front view of FIG. 3, the sleeve member 14 also includes a sleeve, which in this embodiment is comprised of two turned-over side edge flanges forming sleeve portions 46 and 48 on its opposite sides, the internal faces of which form a guide way. As shown in FIG. 2, the sleeve member 14, at its central portion 42, includes a central circular opening 50 therethrough which, in the present embodiment, is centered at a raised boss portion 52 and has an imaginary center. The sleeve member 14 also may include a channel 53 in its lower surface 40 extending from the opening 50 to the front end thereof, as is best seen in FIG. 3.

The slide member 16 fits and slides within the two side sleeve portions 46 and 48 of the sleeve member 14. The slide member 16 may be moved longitudinally within the slide formed by the sleeve portions 46 and 48. As shown in FIG. 2, the slide member 16 is a generally rectangular member which is substantially radiused at one end to form a hook-like lip portion 54. The flat portion of the slide member 16 has an elongated cam opening 56 therethrough. A second generally U-shaped opening 58 may also be provided through the flat portion of the slide member 16 which forms a flexible and resilient tongue 60 having a small raised boss 62 adjacent its end. The boss 62 rides within the channel 53 as the slide member 16 is moved longitudinally within the sleeve member 14.

The cam means 18 is received within the opening 50 of the sleeve member 14 for rotatable movement therein, and the cam member 20 extends from the cam means 18 and into the cam opening 56 of the slide member 16, the details of which will be more fully described below.

The turning means 22, in this embodiment, comprises a handle having inwardly protruding and opposed fingers 64 and 66 which are substantially square in cross-section and fit within the cam means 18, in the manner hereinafter described, for providing rotation of the cam means 18.

In accordance with the present invention, the cam means 18 preferably comprises at least one disc member, such as the type in U.S. Pat. Nos. 2,820,995 and 2,853,751 or, more preferably, two or more disc members, such as the type in U.S. Pat. No. 4,090,727 in which a series of three stacked and interconnected disc members are provided. For purposes of illustration, in the present embodiment the cam means 18 is shown in FIG. 2 comprising the three disc members 68, 70 and 72.

Figure 4:
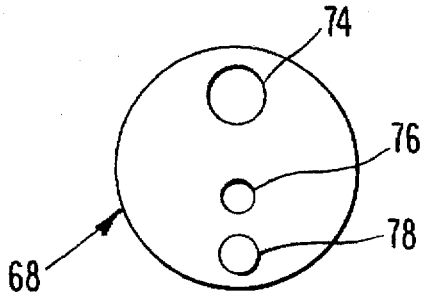
FIG. 4 is a top plan view of a first disc member of FIG. 2.
Figure 5:
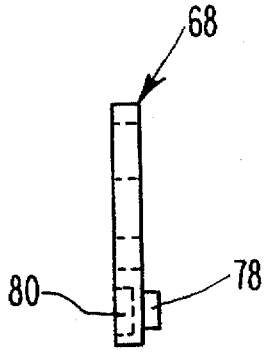
FIG. 5 is a left side elevational view of the first disc member of FIG. 4.

The first disc member 68 as is shown in FIG. 4 is round in top view and its diameter is preferably slightly less than the diameter of the opening 50 in the sleeve member 14 in order to be fit within the sleeve member opening 50. The first disc member 68 preferably has a pair of holes 74 and 76 and a small protruding boss 78. In addition, the first disc member 68 may also include an optional indentation 80 on its side opposite boss 78 and aligned therewith, as shown in dotted line in the side view of FIG. 5. In this embodiment, the boss 62 on tongue 60 of the slide member 16 removably fits in hole 76 as a detent when the slide member 16 is withdrawn. As shown in FIG. 4, the hole 76 is round in shape and extends through the disc member 68, however, the hole 76 can also comprise an indentation which does not extend through the disc member 68. Also, the position of the hole 76 may vary depending on the position of the boss 62 of the slide member 16 or, alternatively, the hole 76 may be eliminated where the boss 62 is not provided or the boss 62 may be adapted to engage the indentation 80 so that the hole 76 is not required. In addition, the hole 74 in the present embodiment is substantially round in configuration, however, it should be understood that other shapes of the hole 74 can also be utilized.

Figure 6:
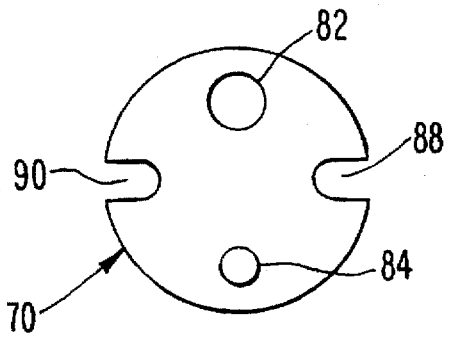
FIG. 6 is a top plan view of a second disc member of FIG. 2.
Figure 7:
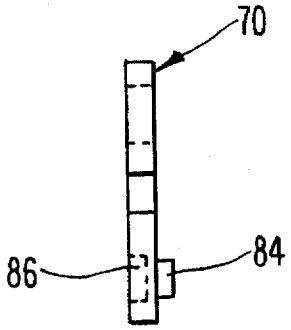
FIG. 7 is a left side elevational view of the second disc member of FIG. 6.

The second disc member 70 as shown in FIG. 6 is also round in top view and preferably has a slightly larger diameter than the diameter of the first disc member 68. In this embodiment, the second disc member 70 rides on top of the boss 52 of the sleeve member 14 and not within the opening 50. The second disc member 70 has a hole 82 which is of the same configuration as the hole 74 in the present embodiment, however, this is not required. The second disc member 70 also is included with a small raised boss 84 and a small indentation 86 behind the boss 84, as shown in dotted line in the side view of FIG. 7. The boss 78 of the first disc member 68 fits within the indentation 86 of the second disc member 70. Alternatively, the small indentation 86 can also comprise a hole extending completely through the second disc member 70. The second disc member 70 as shown in FIG. 6 also includes opposite side indentations 88 and 90 into which are received the fingers 64 and 66 of the turning means 22.

Figure 8:
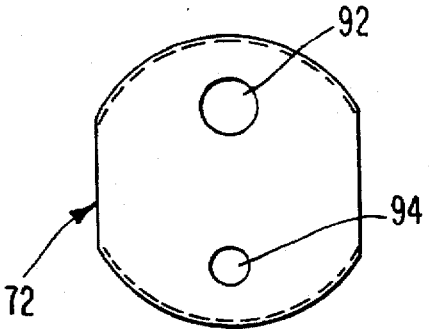
FIG. 8 is a top plan view of a third disc member of FIG. 2.
Figure 9:
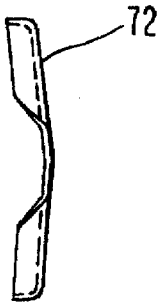
FIG. 9 is a left side elevational view of the third disc member of FIG. 8.

The third disc member 72 as shown in FIG. 8 is preferably of a sufficiently flexible material such as spring metal, for example, sheet metal of spring steel, and includes a hole 92 which, in the present embodiment, is of the same diameter as the holes 74 and 82, however, this is not required. The third disc member 72 also includes a smaller hole 94 or, alternatively an indentation, which the boss 84 of the second disc member 70 fits. In addition, preferably the third disc member 72 is bent slightly along its central axis between the holes 92 and 94, as is best seen in the side view of FIG. 9. The third disc member 72 holds the turning means 22 in position and exerts spring pressure on the substantially square fingers 64 and 66 to tend to restore the turning means to either a flat or raised position.

Figure 10:
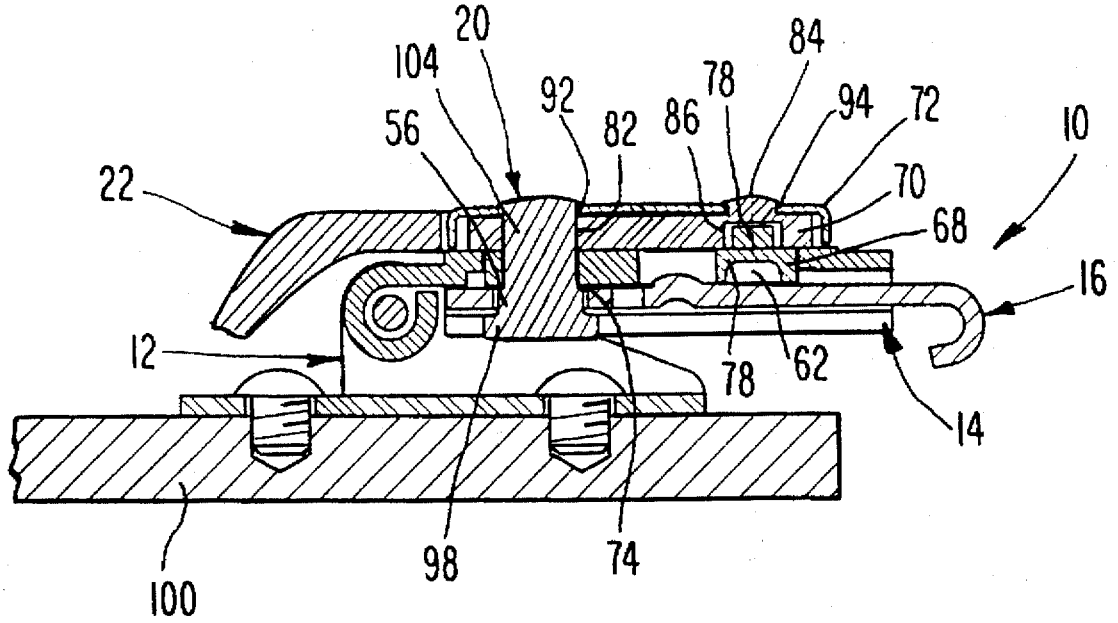
FIG. 10 is a sectional view of the fastener of FIG. 1 taken along the line 10—10.

The interlocking of the three disc members 68, 70 and 72, so that they rotate together as a unit, is accomplished by the bosses 78 and 84 which fit in indentation 86 and hole 94, respectively, as is shown in the sectional view of FIG. 10 taken along the line 10—10 of FIG. 1.

The cam member 20 as shown in FIG. 2 in the present embodiment comprises a rivet having a head 98 and a generally elongated shank 104. As best seen in FIG. 10, the enlarged rivet head 98 is sufficiently large so that its diameter is greater than the width of the elongated cam opening 56 of the slide member 16, which prevents the rivet from being pulled through the opening 56. The shank 104 of the rivet protrudes through the opening 56 and also protrudes through the aligned holes 74, 82 and 92 through the three disc members. The top of the rivet opposite the head 98 is peened-over and forms an enlarged head above the hole 92 in the third disc member to hold the three disc members 68, 70 and 72 together. When the turning means 22 is rotated, the cam member 20 will move within the cam opening 56 of the slide member 16 and rotated about the imaginary center of the opening 50 of the sleeve member 14, which will extend or withdrawal the slide member 16 a predetermined amount, as will be described in detail below. As should be understood, the cam member in accordance with the present invention may also be secured to the first disc member without also extending through it where, for example, the cam member is not required for connection of the disc members or where only one disc member comprises the cam means.

The portions of the fastener 10 described above may be manufactured by conventional techniques and of commercially available materials, such as stamped from sheet metal.

In accordance with the present invention, means are provided for increasing the predetermined amount of extension or withdrawal of the slide member 16. In the present embodiment, the increasing means is provided through the interaction of the first disc member 68 and the cam member 20. Specifically, the hole 74 through the first disc member 68 is positioned closer to the perimeter than to the center of the first disc member 68 which, in turn, also positions the shank 104 of the cam member 20 closer to the perimeter of the first disc member 68 than to its center. The operation of which will be described in the following paragraph.

Figure 11:
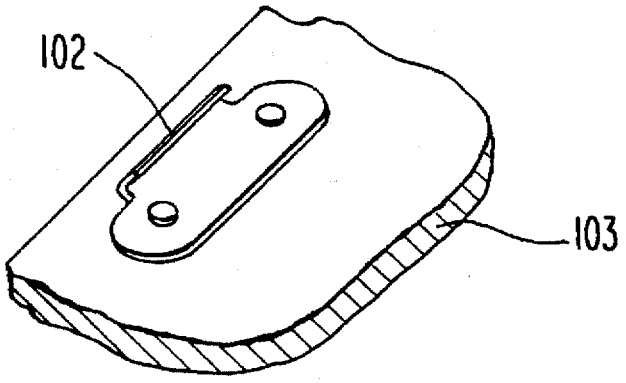
FIG. 11 is an embodiment of a keeper adapted to be engaged by the fastener of FIG. 1.

In operation, starting with the slide member 16 in its extended position, the sleeve member 14 is rotated about the hinge means in order for the hook-like lip portion 54 of the slide member 16 to come into engagement with a keeper 102, which is secured to a second member 103, for example, the second member 103 may be a portion of a lid of a container. As is shown FIG. 11, the keeper 102 comprises a keeper plate portion which is secured to the second member 103 by suitable fastening means and a curved turned-over hook-like keeper lip portion. In this embodiment, the flat keeper plate portion is provided with two holes therethrough in order for fastening to the second member 103 by means of screws or other fastening devices. The keeper 102 may also comprise an extrusion or other shaped keeper. After the slide member 16 engages the keeper 102, the turning means 22 is rotated clockwise, if viewed looking directly down upon the latch. The cam member 20 is also turned clockwise about the imaginary center of the three disc members, with the disc members being aligned so that their centers lie on a common imaginary line. The rivet shank 104 of the cam member 20 pushes on the cam opening 56 and cams the withdrawal of the slide member 16 within the guide-ways of the sleeve portions 46 and 48 of the sleeve member 14. At the end of the turning motion, the slide member 16 is completely withdrawn in the position illustrated in FIG. 10 and the boss 62 of the slide member 16 moves into the indentation 78 of the first disc member 68. Due to the position of the rivet shank 104 being closer to the perimeter than to the center of the first disc member 68, the distance of travel of the slide member 16 within the guide-ways of the sleeve portions 46 and 48 is increased as the slide member 16 is moved by the cam member 20 into the completely withdrawn position from its extended position. In the completely withdrawn position, the hook-like end portion of the keeper 102 is fastened with the hook-like lip portion 54 of the slide member 16.

To unlock the fastener 10 the operation is reversed, specifically, the turning means 22 is rotated counterclockwise, thus causing the rivet shank 104 of the cam member 20 to rotate and thereby cam the slide member 16 to its extended position and also turn the indentation 78 away from the boss 62. Similar to the locking procedure noted above, due to the position of the rivet shank 104 being closer to the perimeter than to the center of the first disc member 68, there is an increase in the distance of travel of the slide member 16 within the sleeve portions 46 and 48 as the slide member 16 is moved by the cam member 20 into its extended position from its completely withdrawn position.

Figure 12:
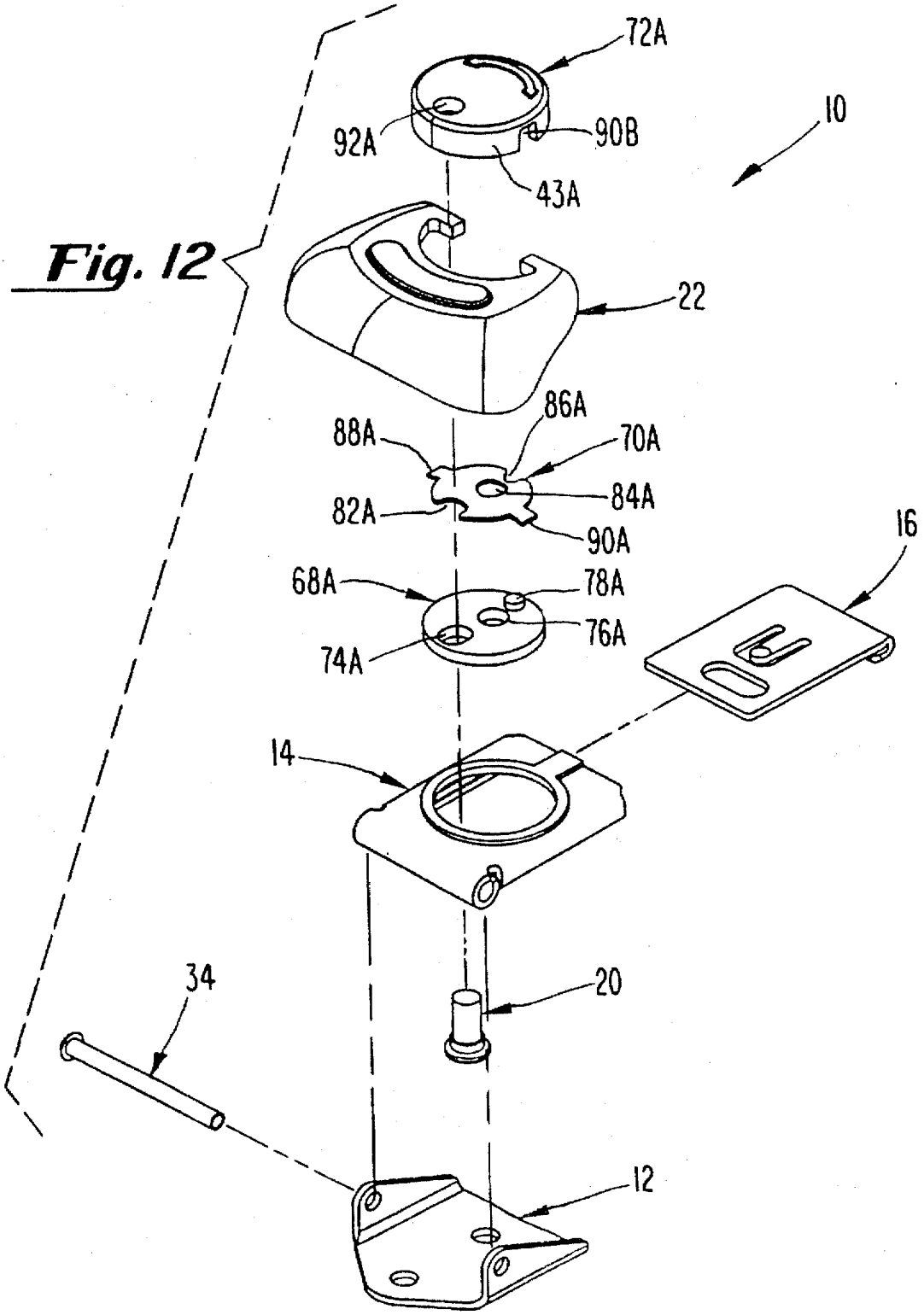
FIG. 12 is an exploded perspective view of a fastener in accordance with another embodiment of the present invention.

Another example of a multiple disc member cam means in relation to the fastener 10 is illustrated in FIG. 12. In this embodiment, the cam means 18 is shown comprising the three disc members 68A, 70A and 72A. The first disc member 68A as shown corresponds in configuration to the disc member 68 set forth above and will not be further described herein for this reason.

Figure 13:
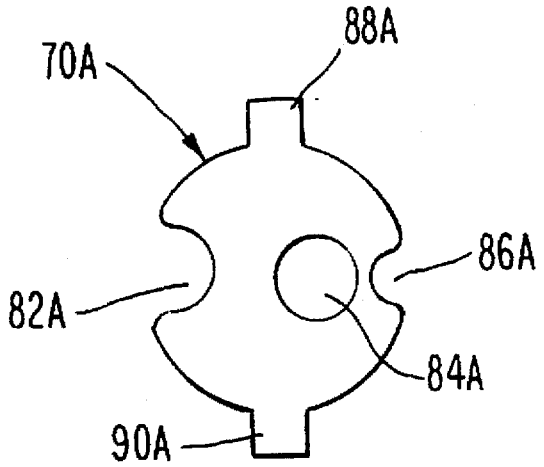
FIG. 13 is a top plan view of a second disc member of FIG. 12.
Figure 14:
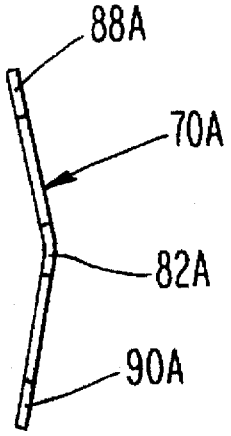
FIG. 14 is a left side elevational view of the second disc member of FIG. 13.

The second disc member 70A as shown in FIG. 13 is preferably of a sufficiently flexible material, such as sheet metal of spring steel, and includes a slot 82A therethrough which, in this embodiment, is substantially radiused in configuration. The slot 82A in operation corresponds to the hole 82 of the disc member 70 described above for receiving the cam member. The second disc member 70A also includes a second slot 86A which is substantially radiused in configuration is this embodiment. The slot 86A corresponds to the indentation 86 of the disc member 70 in its operation for receiving the boss extending from the first disc member. The second disc member 70A preferably also includes a hole 84A round in shape and a pair of opposite side extensions 88A and 90A substantially square in shape. In addition, preferably the second disc member 70A is bent slightly along its central axis bisecting slots 82A and 86A, as is shown in the side view of FIG. 14.

Figure 15:
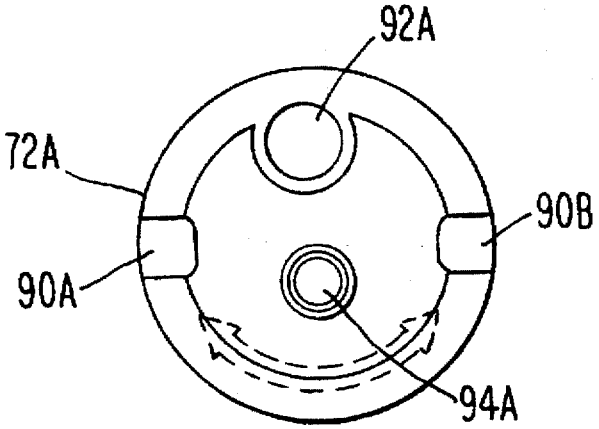
FIG. 15 is a bottom plan view of a third disc member of FIG. 12.
Figure 16:
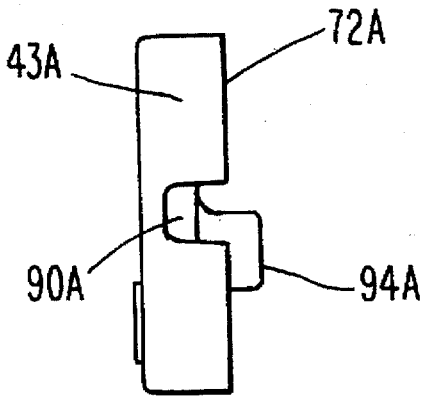
FIG. 16 is a left side elevational view of the third disc member of FIG. 15.

The third disc member 72A as shown in FIG. 12 is round in top view and includes a hole 92A therethrough which is round in shape in this embodiment and which corresponds to the hole 92 of the disc member 72 described above for receiving the cam member. The disc member 72A also includes a downwardly extending flange 43A at its perimeter which includes a pair of opposite side indentations 88B and 90B (only 90B is visible in FIG. 12) which are substantially square in shape in this embodiment, into which fit the substantially square fingers of the turning means and side extensions 88A and 90A of the second disc member 70A. The side indentations 88B and 90B of the third disc member 72A holds the turning means in position and the side extensions 88A and 90A of the second disc member 70A exerts spring pressure on the substantially square fingers to tend to restore the turning means to either a flat or raised position. The third disc member 72A is also included with a small raised boss 94A extending from its lower surface which fits within the hole 84A of the second disc member 70A, as is shown in the bottom and side views of FIGS. 15 and 16.

The interlocking of the three disc members 68A, 70A and 72A so that they rotate together as a unit, is accomplished by the boss 78A of the first disc member 68A and the boss 94A of the third disc member 72A which fit in slot 86A and hole 84A of the second disc member 70A, respectively. The remaining operation of the three disc members 68A, 70A and 72A corresponds to that described above with respect to the disc members 68, 70 and 72.

Figure 17:
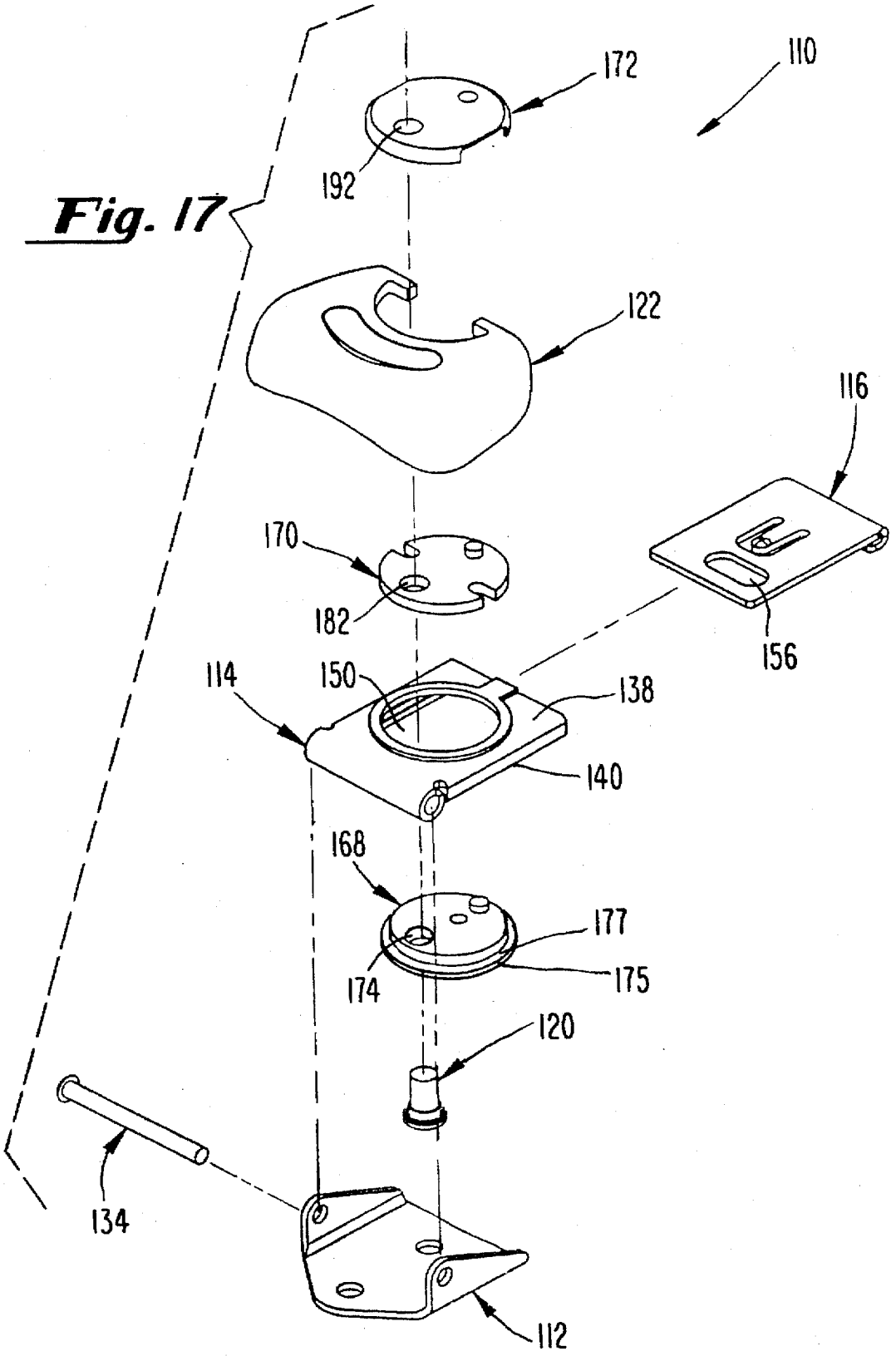
FIG. 17 is a fastener in accordance with another embodiment of the present invention.
Figure 18:
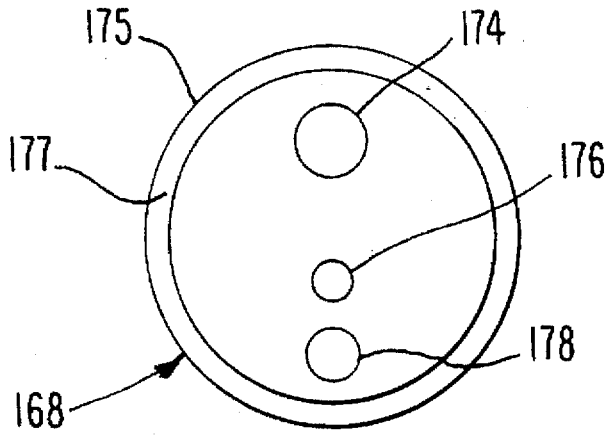
FIG. 18 is a top plan view of a first disc member of FIG. 17.
Figure 19:
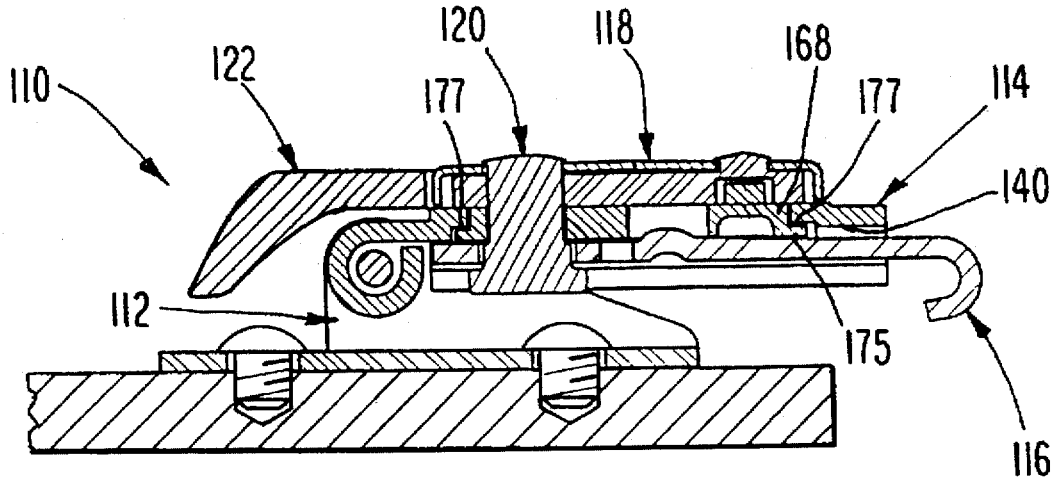
FIG. 19 is a sectional view of the fastener of FIG. 17 and is taken along a line 10—10 shown in FIG. 1.

Another aspect of the present invention is to provide means for retaining a cam mechanism within the opening of a sleeve member as the cam mechanism is rotated. In order to illustrate this feature of the present invention, reference is made to FIG. 17 which illustrates an exploded perspective view of a fastener 110 which incorporates one embodiment of a cam means in accordance with the present invention. For reasons of clarity, the portions of the fastener 110 which correspond to portions described in relation to the fastener 10 will be described using the same number designations beginning with 100. Similar to that described above in relation to the fastener 10, the cam means in accordance with this aspect of the present invention preferably comprises at least one disc member and, more preferably, two or more disc members, such as the types illustrated in FIGS. 2 and 12. As shown in FIG. 17, for purpose of this illustration the earn means comprises the three disc members 168, 170 and 172 which are similar to the disc members 68, 70 and 72 described in relation to the fastener 10. The differences in the disc members 168, 170 and 172 are in the configuration of the first disc member 168 and the positions of the holes 174, 182 and 192 which receive the cam member 120. Specifically, the first disc member 168 in this embodiment is provided having means for engaging the lower surface 140 of the sleeve member 114 proximate the opening 150 of the sleeve member 114 when the disc member 168 is mounted. As illustrated in FIG. 17, the engaging means in this embodiment comprises a flange 175 which extends radially outward from the perimeter of the first disc member 168 adjacent its lower disc surface. Preferably, the flange 175 extends a predetermined amount around the perimeter of the first disc member 168 and, in the present embodiment, the flange 175 as shown in the top plan view of FIG. 18 extends entirely around the perimeter of the first disc member 168. As illustrated by FIGS. 17 and 19, the flange 175 defines an area of increased diameter of the first disc member 168, which operates to retain the cam means 118 within the opening 150 of the sleeve member 114 through its engagement with the inside edge of the cam opening 150 and the sleeve lower surface 140. Specifically, as shown in the sectional view of FIG. 19 taken along the same line shown in FIG. 10, an upper surface 177 of the flange 175 is positioned adjacent, but not necessarily in engagement with, the lower surface 140 of the sleeve member 114 when the cam means 118 is mounted. In this embodiment, as shown in FIG. 17, mounting is accomplished by inserting the first disc member 168 up from the bottom of the sleeve member 114 and through the opening 150 from the direction of the lower surface 140 to the upper surface 138. Similar to that described above in relation to the fastener 10, the three disc members 168, 170 and 172 am interconnected by the cam member 120 extending through the aligned holes 174, 182 and 192 extending through the disc members. Further, in the present embodiment, as shown in FIG. 18 the position of the hole 174 for the first disc member 168 is closer to the perimeter than to the center of the disc member 168, however, it should be understood that this is not required. Specifically, the position of the hole 174 through the first disc member 168 can be provided at any location; for instance, at any position extending from the center to the perimeter of disc member 168. Similarly, the same would apply with respect to the remaining disc members 170 and 172 which are positioned so as to be aligned with the hole 174 extending through the first disc member 168. In addition, as indicated earlier in relation to the first disc member 68, the position of the hole 176 may also be varied or alternatively eliminated in the first disc member 168.

In operation, the upper surface 177 of the flange 175 is adapted to engage the lower surface 140 of the sleeve member 114 which maintains the position of the cam means 118 and also acts as a bearing surface. As indicated earlier, in prior art devices, the first disc member can be dislodged from its position within the slide member when the latch is under load. Generally, in the prior art devices, dislodgement of the first disc member was found to most likely occur at the end opposite of the location of the cam member. In the present invention, the engagement between the flange 175 and the lower surface 140 of the slide member 114 will prevent dislodgement of the first disc member 168 in situations where dislodgement would have occurred in the prior art devices.

The remaining portions and operation of the fastener 110 is the same to that already recited in connection with the fastener 10 and, for the sake of brevity, will not be described in connection with the present embodiment.

Figure 20:
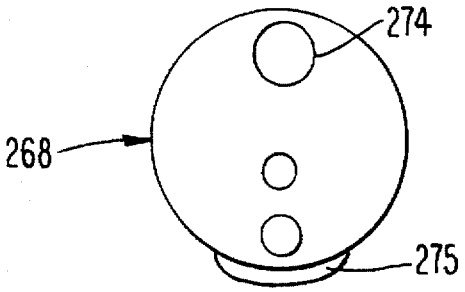
FIG. 20 is a top plan view of another embodiment of a first disc member of FIG. 17.
Figure 21:
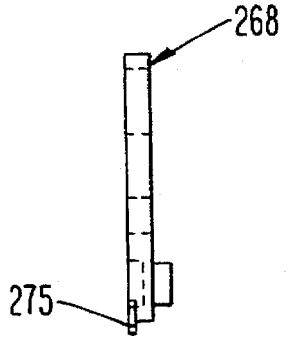
FIG. 21 is a left side elevational view of the first disc member of FIG. 20.

In FIGS. 20 and 21 is shown a second embodiment of a first disc member in relation to the fastener 110. In this embodiment, the first disc member 268 is provided with a single tab 275 which extends only partly around the perimeter of the first disc member 268 and is positioned generally opposite the hole 274. As is shown, the tab 275 extends approximately 45 degrees around the perimeter, however, it should be understood that the tab 275 can extend either less or more around the perimeter of the first disc member 268. Further, in the present embodiment, the position of the tab 275 is generally opposite the hole 274 since, as indicated earlier, dislodgement of the first disc member in prior art devices is most likely to occur at the position of the disc member opposite the cam member. It should be understood, however, that the tab 275 can be provided at other locations along the perimeter of the first disc member 268 where desired. Further, in the present embodiment the tab 275 is shown being generally radiused in shape, however, this is not required and the tab 275 may also be provided of other configurations as well.

Figure 22:
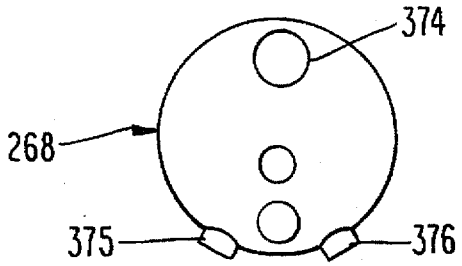
FIG. 22 is a top plan view of another embodiment of the first disc member of FIG. 17.
Figure 23:
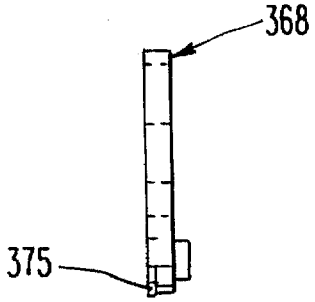
FIG. 23 is a left side elevational view of the first disc member of FIG. 22.

In FIGS. 22 and 23 is shown still another embodiment of a first disc member in relation to the fastener 110. In this embodiment, two tabs 375 and 376 are provided extending from the perimeter of the first disc member 368 generally opposite the hole 374. As shown, the tabs are spaced generally 45 degrees apart and are substantially square in configuration. In the present embodiment, while two tabs 375 and 376 are shown, it should be understood that any number of tabs can be provided for the same purpose, for example 1, 2, 3, etc. Also, the tabs can be of any particular size or configuration, and positioned at any desired location or spacing from each other along the perimeter of the disc member. For example, three tabs can be provided, with the first and third tabs spaced approximately 180 degrees from each other and the second tab positioned generally between the first and third tabs and opposite the cam member. Further, the first and third tab members may be configured similar to the tabs 375, 376 and the second tab member can be configured corresponding to the tab 275. It should be understood that this example is given for illustration purposes only and in no way limits the number of possible variations.

Mounting of the first disc members 268 and 368 described above may be accomplished in the same manner as the first disc member 168 which is up from the bottom of the sleeve member or, alternatively, downward into the sleeve member where possible depending on the particular configuration of the tab portions.

Figure 24:
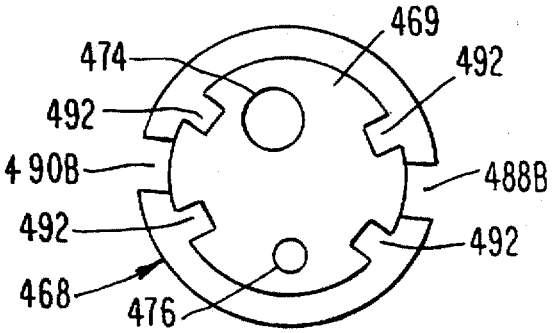
FIG. 24 is a bottom plan view of another embodiment of a first and second disc member of FIG. 17.
Figure 25:
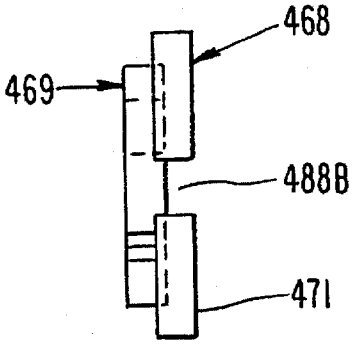
FIG. 25 is a left side elevational view of the first and second disc member of FIG. 24.
Figure 26:
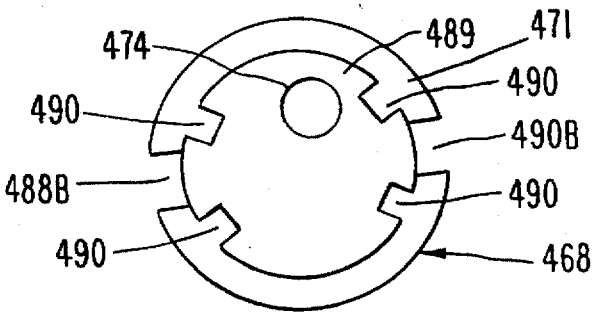
FIG. 26 is a top plan view of the first and second disc member of FIG. 24.

As indicated earlier, another aspect of the present invention is to provide a cam mechanism of increased strength and durability. Specifically, in prior art devices where more than one disc member is provided, such as in U.S. Pat. No. 4,090,727, the disc members can separate and disconnect from one another when the latch is under load, possibly leading to failure of the device. For purpose of illustration, the present feature will be described in relation to the fastener 10. With reference to FIG. 2, in accordance with one embodiment, a cam means is provided by the combination of the third disc member 72 with a disc member 468 shown in FIG. 24 which is in place of the disc members 68 and 70. Advantageously, the disc member 468 is of one-piece in construction which overcomes the problems of the prior art in which multiple disc members would separate and disconnect from one another. The specific configuration of the disc member 468 is best seen in FIGS. 24–26. In this embodiment, the first disc member 468 defines a lower disc 469 and an upper disc 471 which are integrally connected to each other.

The lower disc 469 as shown in FIG. 24 is substantially round in bottom view and includes a hole 474 for receiving the cam member and an indentation 476. As shown in FIGS. 24 and 26, the hole 474 is substantially round in configuration, however other shapes may also be provided. The indentation 476 as shown may also comprise a hole extending completely through the lower disc 469 or alternatively may be deleted. In this embodiment, the boss on the tongue of the slide member removably fits in indentation 476 as a detent when the slide member is withdrawn.

The upper disc 471 as shown in FIG. 26 is round in top view and, in this embodiment, its diameter is greater than the diameter of the lower disc 469. The upper disc 471 also includes a substantially round cavity 489 through its mid section which extends to the lower disc 469. In this embodiment, the upper disc 471 also includes four support members 490 within its cavity 489 and engaging the lower disc 471 for reinforcing the connection therebetween. The lower disc 469 as shown in FIG. 24 also includes four indentations 492 generally opposite the position of the four support members 490, however, the indentations 492 may be deleted where desired. The upper disc 471 is also included with a pair of opposite side indentations 488B and 490B which, in this embodiment, are substantially square in shape and receive the substantially square fingers of the turning means. The disc member 468 can be manufactured by conventional techniques and of commercially available materials, such as being extruded from metal. In this embodiment, the hole 94 through the disc member 72 shown in FIG. 2 is not required and may be deleted.

Mounting of the disc member 468 in this embodiment is accomplished by inserting the lower disc 469 downward into the opening of the sleeve member until the upper disc 471 comes into engagement with the upper surface of the sleeve member. The remaining operation is the same as that described earlier.

Figure 27:
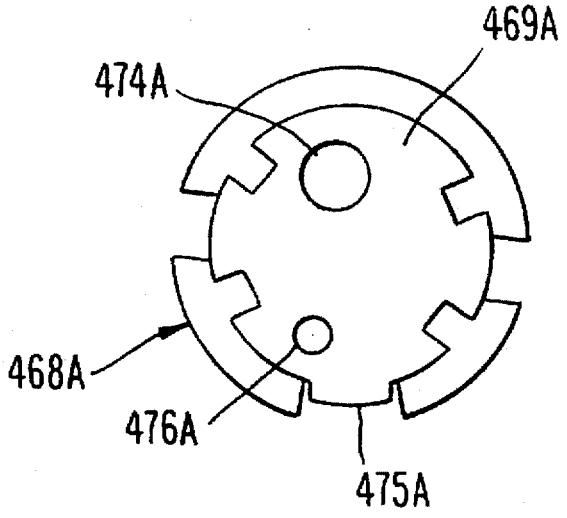
FIG. 27 is bottom plan view of another embodiment of the first and second disc member of FIG. 24.
Figure 28:
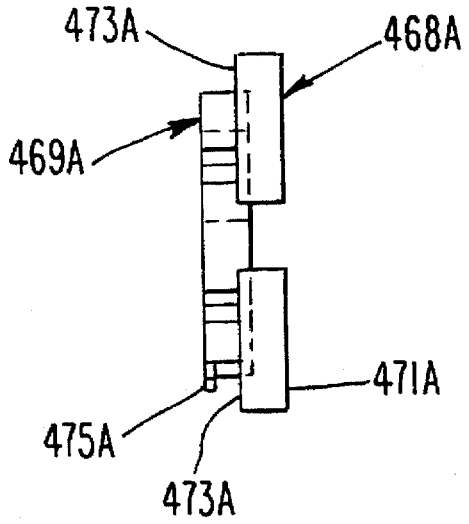
FIG. 28 is a left side elevational view of the first and second disc member of FIG. 27.
Figure 29:
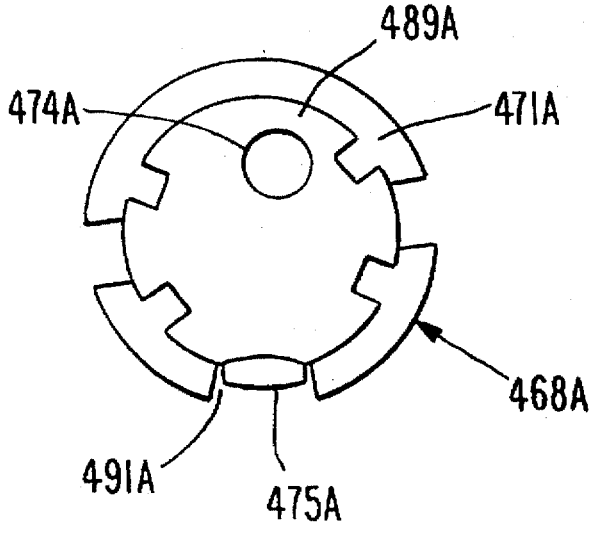
FIG. 29 is a top plan view of the first and second disc member of FIG. 27.

The cam means 418 in accordance with the present invention may also incorporate one or both of the features described above; namely, means for increasing the predetermined amount of extension or withdrawal of the slide member or means for retaining the cam means within the opening of the sleeve member. Similar to that described above in relation to the fastener 10, the increasing means can be provided through the interaction of the cam member with the hole 474 through the lower disc 469; in particular, the position of the hole 474 being provided closer to the perimeter of the lower disc 469 than to the center of the lower disc 469. In addition, the retaining means can be provided through the interaction of the disc member 468 with the sleeve member, similar to that described in relation to the fastener 110. For purpose of illustration only, in FIGS. 27–29 is shown a disc member 468A which incorporates each of the foregoing features. As should be understood, alternative embodiments may incorporate either one of the two features hereinafter described.

The lower disc 469A in this embodiment includes a single tab 475A which extends only partly around the perimeter of the lower disc 469A and is positioned generally opposite the hole 474A. It should be understood however that while a single tab 475A is illustrated, one or more tabs can be provided of any desired configuration and positioned at any desired location along the perimeter of the lower disc 469A, such as that described above in relation to the disc members 268 and 368. In the present embodiment, the interaction of the tab 475A with the bottom surface of the sleeve member operates to retain the cam means within the sleeve member opening. In addition, the interaction of the upper disc 471A with the sleeve member provides an additional mechanism for retaining the position of the cam means. Specifically, as shown in FIG. 28 the lower surface 473A of the upper disc 471A is adapted to come into engagement with the upper surface of the sleeve member as the cam means is rotated. Further, as illustrated in FIG. 29, in the present embodiment the upper disc 471A is provided with an indentation 491A adjacent the tab 475A, however it should be understood that the indentation 491A may be deleted where desired.

As shown in FIGS. 27 and 29, the increasing means in this embodiment is provided by the lower disc 469A which includes a hole 474A positioned closer to the perimeter than to the center of the lower disc 469A. In addition, the top disc member which is illustrated by the disc member 72 in FIG. 2 is accordingly provided with a hole 92 which is positioned so as to be aligned with the hole 474A in order to accommodate receiving the cam member through each of the holes 474A and 92, respectively. As indicated earlier, the interaction of the cam member and the lower disc 469A provides an increased amount of extension or withdrawal of the slide member as the cam means 418A is rotated. The remaining features of the disc member 468A are the same as that recited above with respect to the disc member 468.

Another aspect of the present invention is to provide a fastener of compact design so that the fastener may be mounted in smaller areas but which will still provide sufficient force in order to properly latch. In accordance with this feature of the present invention, in FIG. 30 there is shown a side view of one embodiment of a fastener 510. Fastener 510 as shown includes, as portions thereof, a base member 512, a sleeve member 514, a biasing means 515, a slide member 516, cam means 518, a cam member 520, and turning means 522. In the present embodiment, the structure and operation of the slide member 516 and turning means 522 are the same as that described in relation to the fastener 10 and will not be described further herein for this reason. The cam means 518 and cam member 520 may comprise any of the cam means 18, 118, 218, 318 or 418 and associated cam members described above, or any prior art arrangements which are adapted for this purpose, such as that described in the prior art patents noted earlier in the background of the invention. For purposes of illustration, in the present embodiment, the cam means 518 corresponds to the cam means 218 and will not be described in further detail for this reason.

Figure 31:
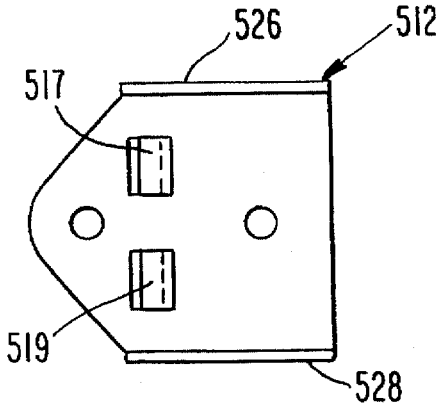
FIG. 31 is a top plan view of a base member of FIG. 30.
Figure 32:
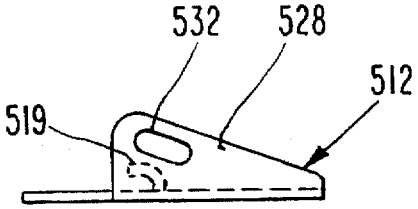
FIG. 32 is a side elevational view of the base member of FIG. 31.

The base member 512 as shown in the top view of FIG. 31, includes extending upward from its bottom portion at least one and preferably two bosses 517 and 519. The bosses 517 and 519 may also include a substantially annular hook-shaped end portion, as is shown in dotted line in the side view of FIG. 31 (only 519 is visible). In the present embodiment, the bosses 517 and 519 are generally rectangular in shape and are formed from a bent up section of the bottom portion of the base member 512. However, bosses 517 and 519 can be provided having any desired shape, or as separate members which are attached to the bottom portion of the base member 512. In addition, any number of bosses can be provided for the same purpose. The base member 512 further includes two inclined generally elongated shaped-slots 530 and 532 provided through the opposing side portions 526 and 528, respectively. In the present embodiment, the slots 530 and 532 extend with a downward slant of approximately 40° to the bottom portion from near the upper corners toward the front end. However, the slots 530 and 532 may be inclined at any desired angle; a preferable range is between 30° and 50°.

Figure 30:
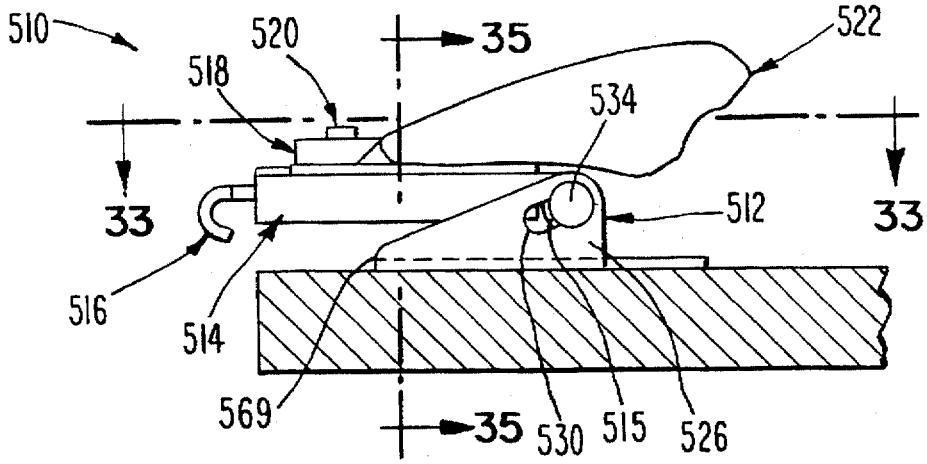
FIG. 30 is a side elevational view of a fastener in accordance with another embodiment of the present invention, shown mounted to a panel.
Figure 33:
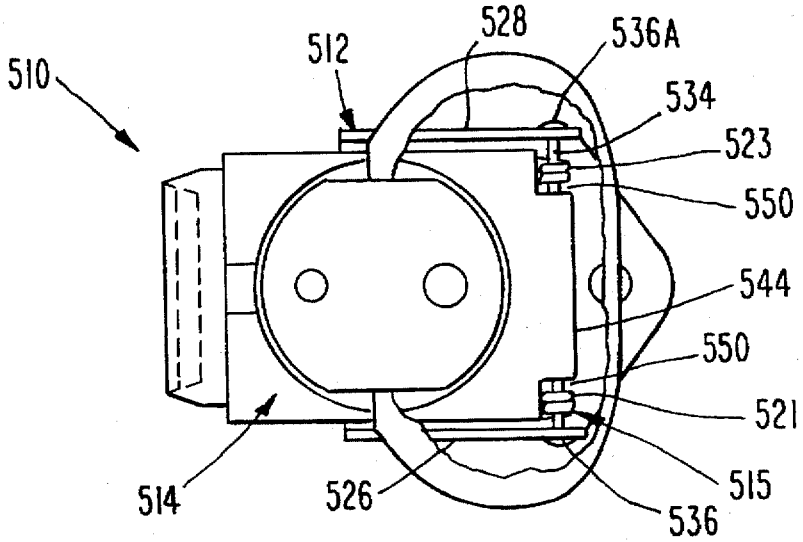
FIG. 33 is a sectional top plan view taken along the line 33—33 of FIG. 30.

As shown in the sectional view of FIG. 33 taken along the line 33—33 of FIG. 30, the sleeve member 514 is pivotally connected by hinge means to the base member 512. Similar to that described above in relation to the fastener 10, the hinge means comprises a pin 534 and tubular portion 544 of the sleeve member 514. Further, the pin 534 preferably includes a head 536 at one of its ends and a peened-over portion 536A at the opposite end, which am each positioned on the outside of the opposing side portions 526 and 528 through the slots 530 and 532 of the base member 512. In addition, the pin 534 is received within the tubular portion 544 for connection of the sleeve member 514. In this embodiment, the tubular portion 544 does not extend the entire width of the sleeve member 514, which is different from the arrangement with respect to the tubular portion 44 of the sleeve member 14. In particular, each of the opposing side portions of the sleeve member 514 step inwardly proximate the tubular portion 544 which define substantially square-shaped openings 550.

Figure 34:
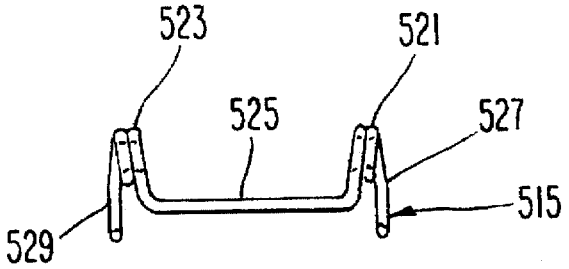
FIG. 34 is a front elevational view of a biasing means of FIG. 30.

As shown in FIG. 34, the biasing means 515 in the present embodiment comprises a torsion spring preferably comprised of metal, such as stainless steel, although other suitable materials may also be used. The torsion spring 515 in the present embodiment preferably comprises two wound portions 521 and 523, a generally U-shaped section 525 extending between the wound portions 521 and 523, and a pair of end sections 527 and 529 extending from the opposite ends of the wound portions 521 and 523. Although not shown, it should be understood that variations in the torsion spring 515 may be provided, such as providing a different configuration of torsion spring, varying the number of wound portions, varying the number of windings in each wound portion, to name a few. The primary consideration is that the torsion spring 515 when mounted will be positioned substantially within the exterior boundaries of the base member 512, an example of which is illustrated in the present embodiment.

Figure 34A:
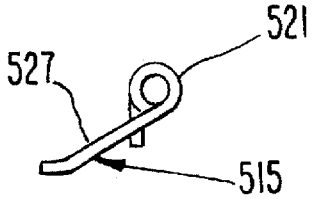
FIG. 34*a* is a right side elevational view of the biasing means of FIG. 34.
Figure 35:
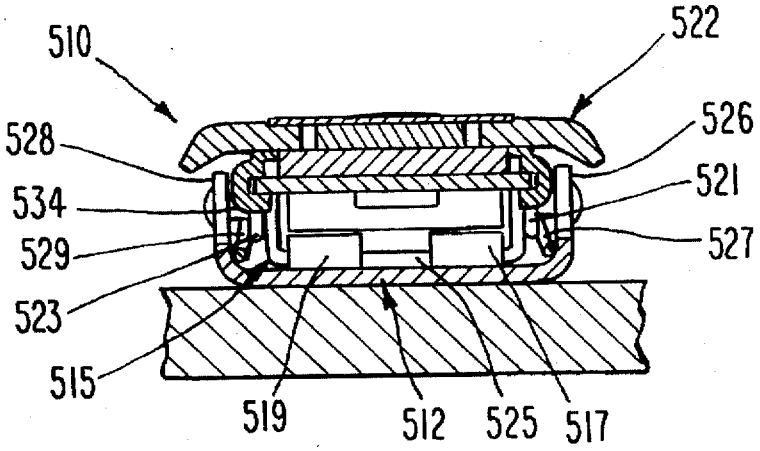
FIG. 35 is a sectional front elevational view taken along the line 35—35 of FIG. 30.

As illustrated in the sectional view of FIG. 35 taken along the line 35—35 of FIG. 30, the pin 534 when mounted fits within the two wound portions 521 and 523 and the U-shaped portion 525 is in engagement with the two bosses 517 and 519 extending upward from the bottom portion of the base member 512. As best seen in FIG. 33, the two wound portions 521 and 523 are positioned within the substantially square-shaped openings 550 of the sleeve member 514. As shown in FIG. 35, preferably the opposing end portions 527 and 529 of the torsion spring 515 extend in the direction of the front of the base member 512, and also may be positioned so as to bias against the opposing side portions 526 and 528 and the bottom portion of the base member 512. Further, the end portions 527 and 529 may also be slightly bent at its terminating ends, as shown in the side view of FIG. 34*a*.

When the fastener 510 is in an unlatched position, preferably the pin 534 is positioned against the upper most ends of the slots 530 and 532 near the upper corners of the base member 512, as illustrated in FIG. 30.

In operation, when the fastener 510 is latched with the keeper, the force of the torsion spring 515 is adapted to provide an additional latching force in order to secure the panels together. As the slide member 516 is withdrawn and latched with the keeper, the pin 534 preferably moves against the bias of the torsion spring 515 downward in the slots 530 and 532 in the direction of the bottom portion of the base member 512. The wound portions 521 and 523, due to the connection with the pin 534, are also moved in the same direction of movement of the pin 534. Similarly, the opposing end portions 527 and 529 of the torsion spring 515 are moved forward toward the front edge 569 of the base member 512 coinciding with the movement of the wound portions 521 and 523. The U-Shaped portion 525 of the torsion spring 515 is retained in position by the bosses 517 and 519 in order to prevent forward motion of the U-shaped portion 525. In the fully latched position, preferably the pin 534 is positioned between the upper most ends and the lower most ends of the slots 530 and 532. Generally, the position of the keeper relative to the fastener 510 determines the position of the pin 534 within the slots 530 and 532 when the fastener 510 is in a fully latched position. Further, the amount of force provided by the fastener 510 may also be increased or decreased by varying the angle and/or the length of the slots 530 and 532 within the base member 512. The particular configuration of the keeper is the same as that earlier described in relation to the keeper 102.

When the fastener 510 is unlocked, the foregoing sequence is reversed and the position of the pin 534 is moved by the bias of torsion spring 515 toward the upper most ends of the slots 530 and 532.

Generally, the operation of fastener 510 described above is similar in operation to that shown in U.S. Pat. No. 2,820,995. However, one advantage of the present design is that the torsion spring 515 is entirely confined within the boundaries of the base member 512. Specifically, the torsion spring 515 is positioned within the base member 512 between the two opposing side portions 526 and 528. As indicated earlier, fasteners of the type shown in U.S. Pat. No. 2,820,995 incorporate spring arrangements which extend out away from the fastener itself which both increase the size of the fastener and also affects the fasteners overall appearance. Rather, in the present embodiment, since the torsion spring 515 is confined within the exterior boundaries of the base member 512, the overall size or "foot print" of the fastener is reduced, which both allows mounting of the fastener in smaller areas and also improves the aesthetics of the device. Another advantage is that the sleeve member 514 and the base member 512 are connected by the pin 534 which also increases the overall strength characteristics of the fastener 510.

In FIGS. 36 to 48 are illustrated alternative embodiments of the biasing means 515 described above. The common feature in each of these embodiments is that the biasing means is confined within the boundaries of the base member. In order to simplify the following description, only those portions which are different from that shown in FIGS. 30–35 will be described.

Figure 36:
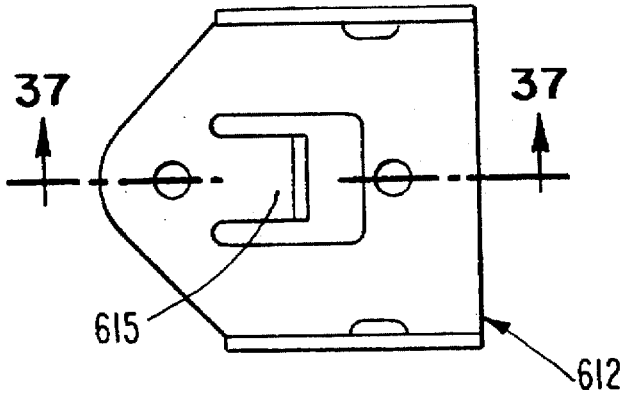
FIG. 36 is a top plan view of another embodiment of a biasing means of FIG. 30.
Figure 37:
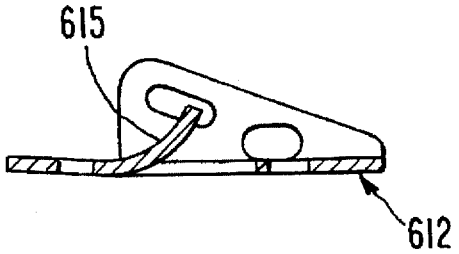
FIG. 37 is a sectional side elevational view taken along the line 37—37 of FIG. 36.

In FIGS. 36 and 37 is illustrated a first alternative embodiment of the biasing means of FIG. 515. The biasing means in this embodiment comprises a resilient member 615 defining a cantilever spring which extends upward from the bottom portion of the base member 612. In the present embodiment, preferably, the resilient member 615 both extends from and is integral with the bottom portion of the base member 612, however, the resilient member 615 may also be provided as a separate element secured to the bottom portion of the base member 612. Where the resilient member 615 is an integral part of the base member 612, an advantage is that there is a reduction in the number of components of the fastener. Further, in the present embodiment, preferably the resilient member 615 is generally rectangular in configuration and is generally radiused along its entire length. The resilient member 615 may be formed by conventional techniques, such as stamping or casting.

In operation, the tubular portion of the sleeve member is adapted to come into engagement with the resilient member 615 proximate its terminating end when the fastener is latched. Preferably, the configuration of the sleeve member includes a tubular portion which extends the entire width of the sleeve member, which is similar to that described in relation to the sleeve member 14 of the fastener 10.

Although not shown, the base member 612 may also be rotated 180° in position to provide an "outboard" arrangement. In this situation, operation of the latch would occur is the same manner described above.

FIGS. 38–48 are alternate embodiments of which illustrate variations of the resilient member 615 described above. Generally, FIGS. 38–48 illustrate several variations in the shape, configuration and number of resilient members provided in the base member. It should be understood that the following embodiments are for example only and by no way limit the possible variations which are within the scope and spirit of the invention.

Figure 38:
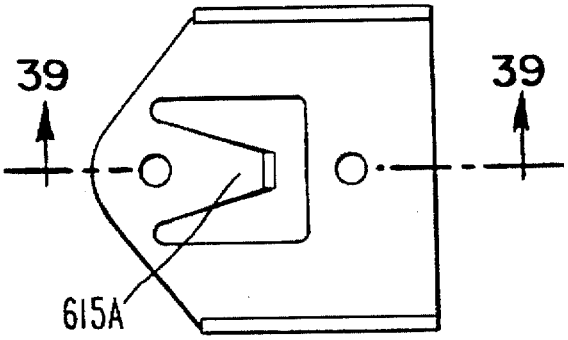
FIG. 38 is a top plan view of another embodiment of a biasing means of FIG. 30.
Figure 39:
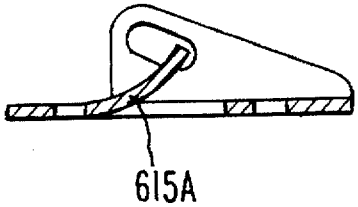
FIG. 39 is a sectional side elevational view of the biasing means of FIG. 38.

In FIGS. 38 and 39 is shown a resilient member 615A which is substantially V-shaped.

Figure 40:
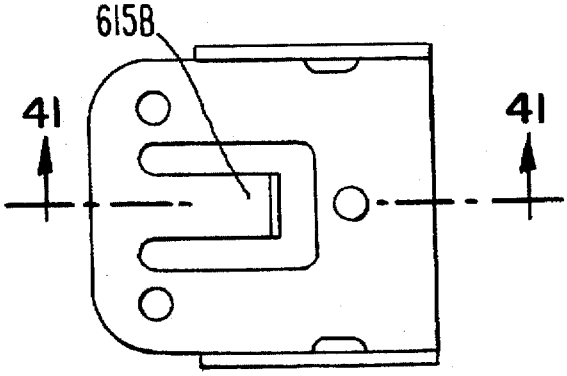
FIG. 40 is a top plan view of another embodiment of a biasing means of FIG. 30.
Figure 41:
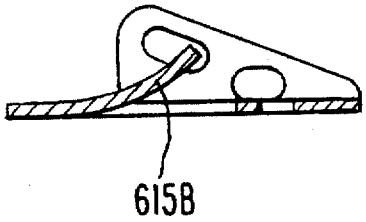
FIG. 41 is a sectional side elevational view taken along the line 41—41 of FIG. 40.

In FIGS. 40 and 41 is shown a resilient member 615B which is slightly narrower and longer than the resilient member 615.

Figure 42:
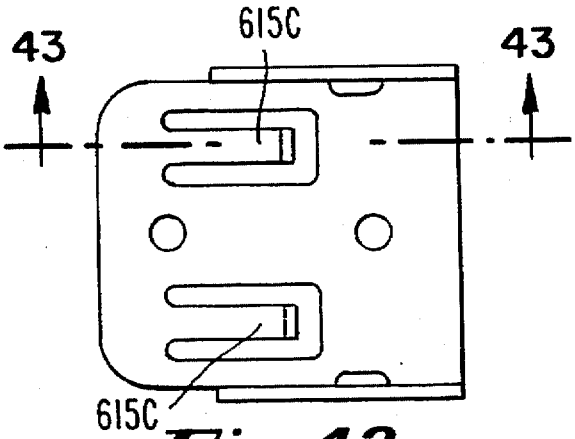
FIG. 42 is a top plan view of another embodiment of a biasing means of FIG. 30.
Figure 43:
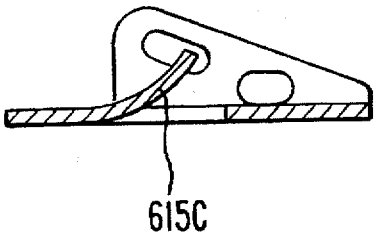
FIG. 43 is a sectional side elevational view of the biasing means of FIG. 42.

In FIGS. 42 and 43 is illustrated a pair of resilient members 615C. Advantages of this design are increased load capacity due to the additional resilient member, and the position of two resilient members 615C also work to keep the sleeve member centered during operation.

Figure 44:
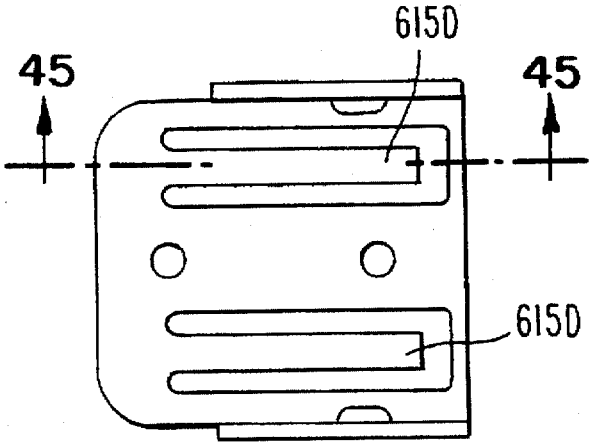
FIG. 44 is a top plan view of another embodiment of a biasing means of FIG. 30.
Figure 45:
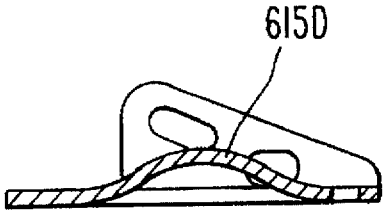
FIG. 45 is a sectional side elevational view of the biasing means of FIG. 44.

In FIGS. 44 and 45 is illustrated a pair of generally sloped resilient members 615D defining a beam type leaf spring configuration. Specifically, as best seen in the side view of FIG. 45, the resilient members 615D slope upward from the bottom portion of the base member to approximately its mid portion, and then slope downward back in the direction of the bottom portion of the base member. In operation, the tubular portion of the sleeve member is adapted to engage the upward sloped curve of the resilient members 615D. Additional advantages of this design are an increased load capacity and the double spring arrangement also works to keep the sleeve member centered during operation.

Figure 46:
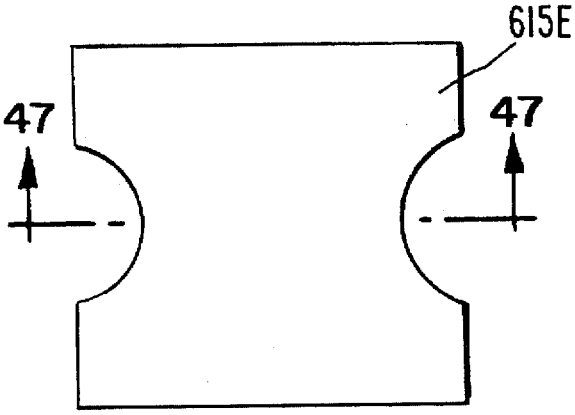
FIG. 46 is a top plan view of another embodiment of a biasing means of FIG. 30.
Figure 47:
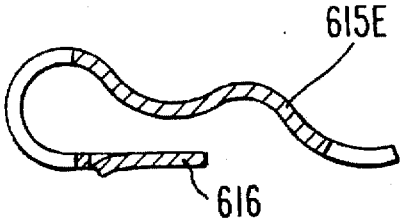
FIG. 47 is a sectional elevational view of the biasing means taken along the line 47—47 of FIG. 46.
Figure 48:
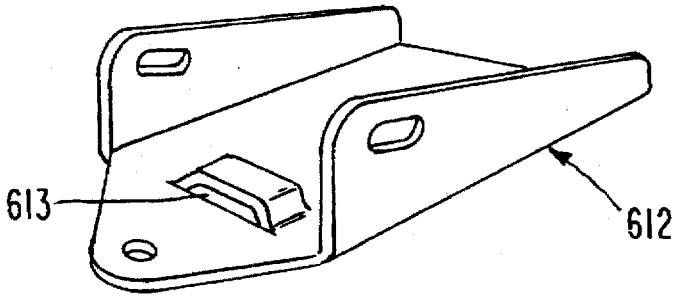
FIG. 48 is an embodiment of a base member adapted to receive the biasing means of FIG. 46.

In FIGS. 46–48 the resilient member 615E comprises a separate curved leaf spring, preferably of sufficiently resilient material, such as from spring steel materials, which is retained to the base member 612 by engaging a slot 613 formed within the bottom portion. Specifically the end portion 616 of the resilient member 615E is inserted into the slot 613. The particular configuration of the resilient member 615E may also be varied where desired, such as the shape of the curved portions. In operation, the tubular sleeve portion is adapted to engage the curved portion of the resilient member 615E.

Figure 49:
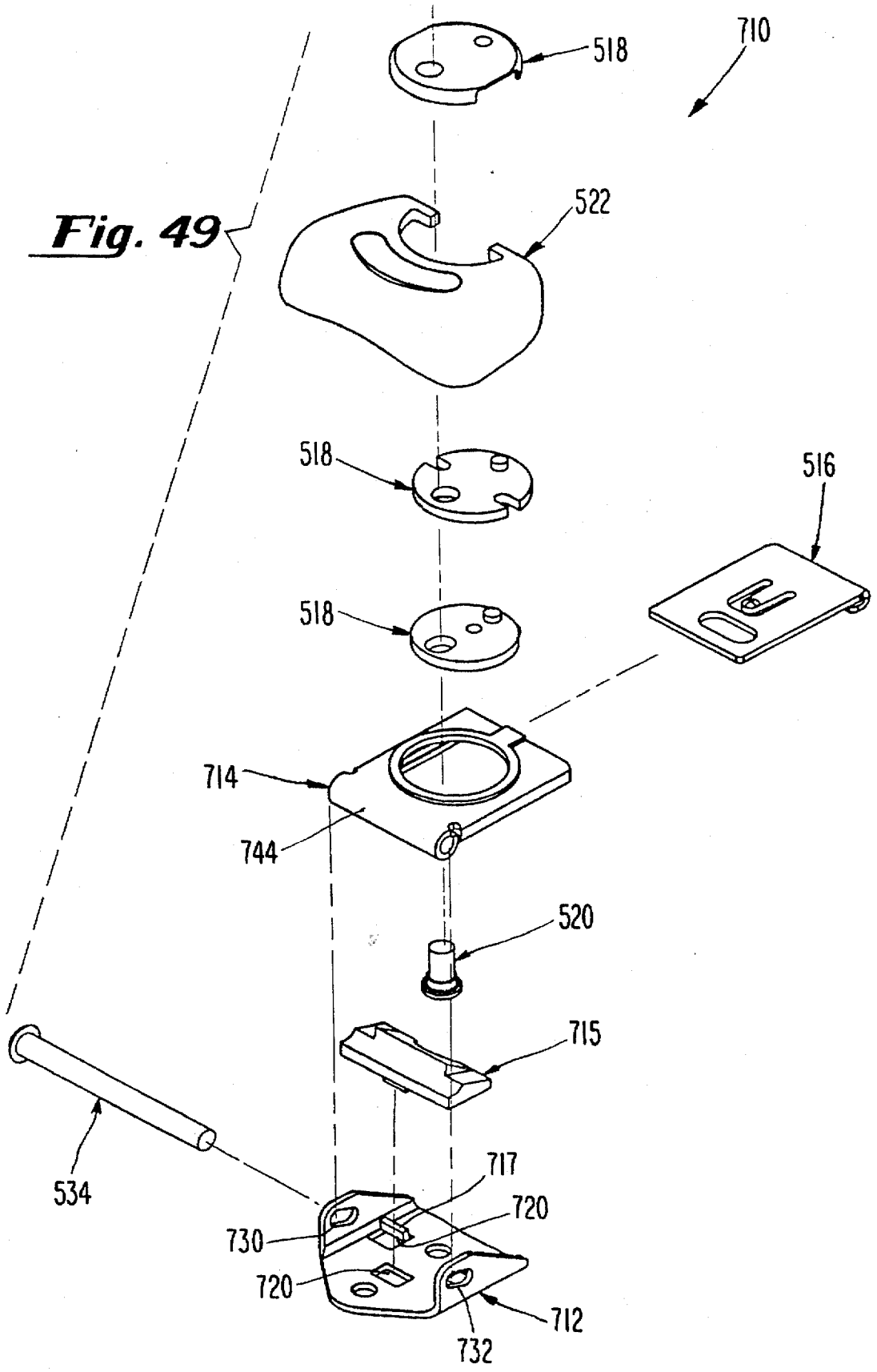
FIG. 49 is an exploded perspective view of a fastener in accordance with another embodiment of the present invention.

Another embodiment of the biasing means 515 is shown in FIG. 49. In FIG. 49, the differences of the fastener 710 from the fastener 510 shown in FIGS. 30–35 are in the configuration of the biasing means, sleeve member and base member, which will hereinafter be described. For the sake of brevity, the similar portions will not be described and are designated by the same numbers shown in FIG. 30.

Figure 50:
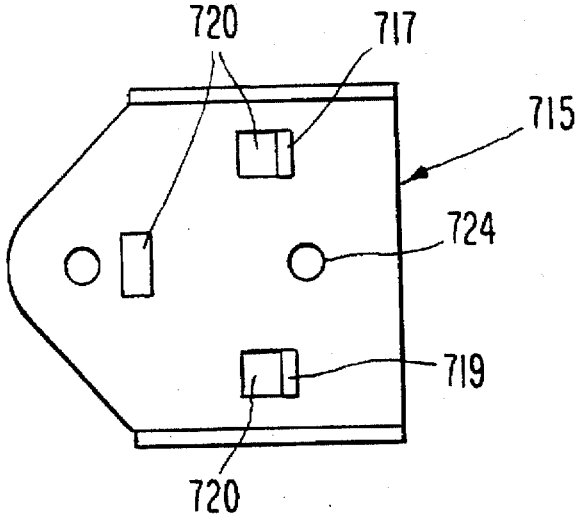
FIG. 50 is a top plan view of a base member of FIG. 49.

As shown in the exploded view of FIG. 49 and top view of FIG. 50, the base member 712 includes extending upward from its bottom portion at least one and preferably a pair of bosses 717 and 719 which, as shown, may also be sloped rearward in the direction of the slots 730 and 732 in the base member 712. In this embodiment, the bosses are generally rectangular in cross-section and formed from a bent up portion of the base member 712. However, the bosses 717 and 719 may also be provided as separate elements attached to the bottom portion of the base member 712 and of any suitable cross-section.

Figure 51:
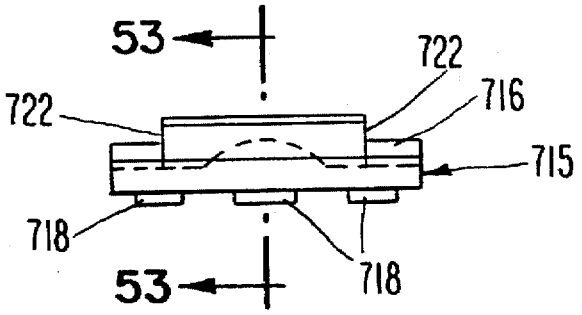
FIG. 51 is a front elevational view of a biasing means of FIG. 49.
Figure 52:
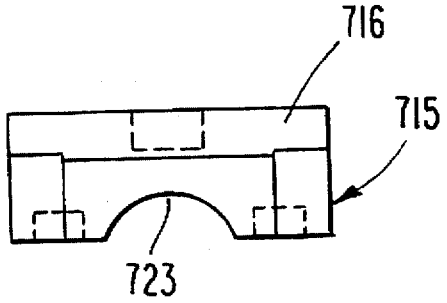
FIG. 52 is a top plan view of the biasing means of FIG. 51.
Figure 53:
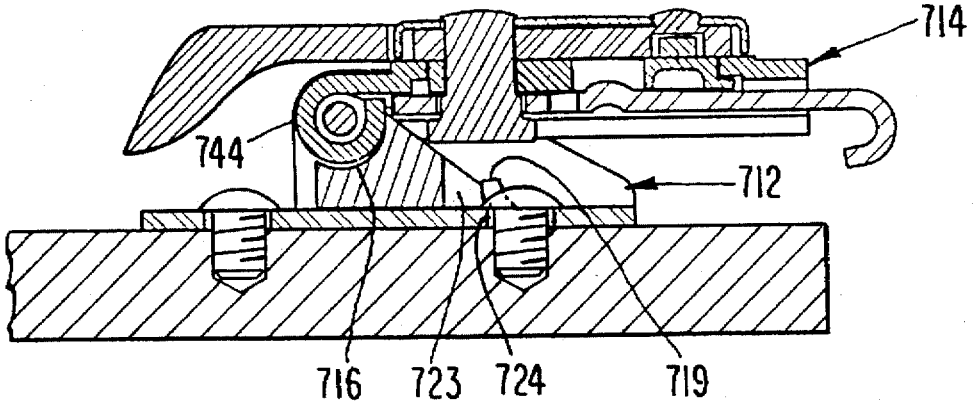
FIG. 53 is a sectional side elevational view of the fastener of FIG. 49 and taken along the line 10—10 of FIG. 1.

The biasing means 715 in the present embodiment is comprised of an elastomer material which operates as a compression spring. The elastomer material may comprise polyurethane, silicone, thermoplastic elastomer, urethane plastic, EDPM rubber or other suitable materials. In the present embodiment, as is illustrated in the front view of FIG. 51 and top view of FIG. 52, the elastomer biasing means 715 is generally rectangular in configuration and includes a generally radiused slot 716 formed in its upper end along its longitudinal axis, which is adapted to engage the tubular portion 744 of the sleeve member 714, as is shown in FIG. 53. FIG. 53 is a sectional view similar to that shown in FIG. 19. Further, preferably, the top surface of the elastomer biasing means 715 as shown in FIG. 53 tapers downward from the radiused slot 716 and in the direction of its front end, which in turn engages the bosses 717 and 719 in order to prevent forward motion of the elastomer biasing means 715. Further, the biasing means 715 may also be provided with at least one boss extending from its lower surface which is received within a corresponding aperture formed in the bottom portion of the base member 712, which provides an additional retaining force to forward motion of the elastomer biasing means 715. In the present embodiment, as best seen in FIG. 51, three bosses 718, each generally rectangular in cross-section, are provided extending from the lower surface and arranged in two lines, with one boss in the middle of the back end and two bosses at each corner in the front end of the elastomer biasing means 715, and three corresponding apertures 720 are formed in the bottom portion of the base member 712 for receiving the three bosses, as best seen in FIG. 50. However, it should be understood that any number of bosses having any suitable cross-section and positioned at any location on the bottom surface of the elastomer biasing means 715 can be provided which, in turn, are received within corresponding apertures formed in the bottom portion of the base member 712. In addition, the elastomer biasing means 715 may also include in its upper surface opposing downwardly stepped sections 722 adjacent its side portions which receive the opposing sleeve portions of the sleeve member when the sleeve member is rotated. The elastomer biasing meas 715 may also have a semi-circular cut-out 723 in its front end so as to allow sufficient clearance for the screw connection of the base member 712 through the hole 724.

As indicated earlier with respect to the torsion spring biasing means, the important aspect of the elastomer biasing means is that when mounted it will be positioned substantially within the exterior boundaries of the base member. Therefore, it should be understood that the biasing member 715 may also be of other configurations than that shown without departing from the spirit and scope of the present invention.

In operation, the elastomer biasing means 715 provides spring retention of the sleeve member via the engagement of the tubular portion 744 with the curved portion of the elastomer biasing means 715. One advantage of the elastomer biasing means is that increased load carrying capacity can be obtained over the prior art metallic spring designs or the above-identified metallic biasing means designs. Further, the material, hardness or shape of the elastomer biasing means can be varied to either increase or decrease the spring rate of the latch where desired.

Figure 54:
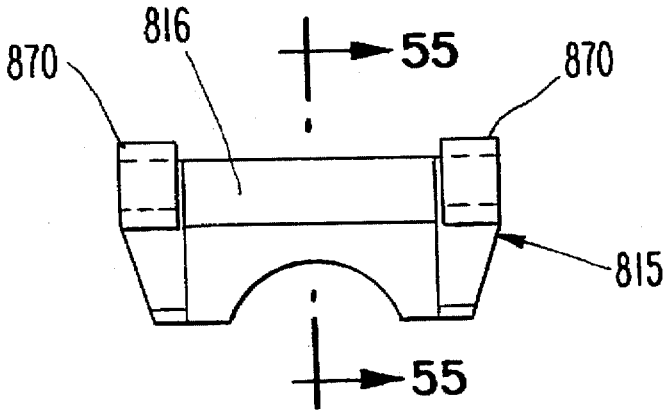
FIG. 54 is a top plan view of another embodiment of a biasing means of FIG. 49.
Figure 55:
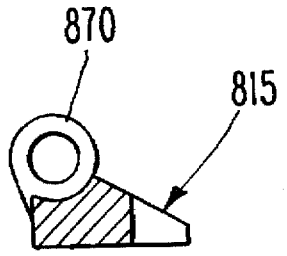
FIG. 55 is a sectional side elevational view taken along the line 55—55 of FIG. 54.
Figure 56:
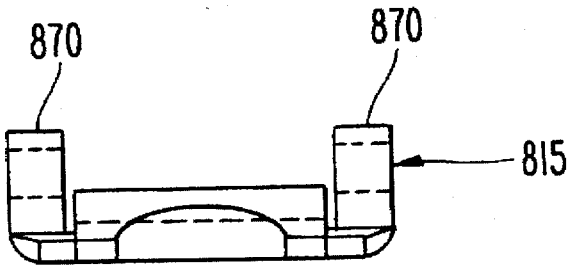
FIG. 56 is a front elevational view of the biasing means of 54.

In FIGS. 54–56 is illustrated another embodiment of the biasing means 715 shown in FIG. 49. As shown in FIG. 54, the elastomer biasing means 815 in this embodiment is also a generally rectangular member and includes within its upper surface a substantially radiused slot 816 extending along its longitudinal direction, similar to the slot 716 described above. However, one difference is that the elastomer biasing means 815 includes a pair of protrusions 870 at opposite ends of the generally radiused slot 816 which are provided with through holes which are adapted for receiving the pin 534 shown in FIG. 49. Another difference from that shown in FIG. 49 is that the particular configuration of the sleeve member adapted to be used with the biasing means 815 corresponds to the configuration of the sleeve member 514 described above and shown in FIG. 33, so that the tubular portion 544 would be positioned within the generally radiused slot 816 between the two protrusions 870. The protrusions 870 in turn would be positioned within the square-shaped openings 550 formed in the sleeve member 514. The remaining portions of the biasing means 815 correspond to the biasing means 715 described above. For example, the elastomer biasing means 815 may also include a specific number of bosses extending from its lower surface which are received within corresponding apertures formed in the bottom portion of the base member similar to the base member 712 described above. In addition, the base member may also include one or more bosses which engage the biasing means 815, similar to the base member 712. Further, the biasing means 815 may be comprised of the variety of materials described in relation to the biasing means 715, and be of alternate configurations than that shown.

The operation of the elastomer biasing means 815 is similar to the operation of the elastomeric biasing means 715. The primary difference is that pin 534 operates to retain the elastomer biasing means 815 through its engagement with the two protrusions 870. Further, an additional spring force is provided from the two protrusions 870.

In view of that set forth above, it should be understood that the present invention possesses several advantages over conventional fasteners. One advantage is that the present invention provides an increased extension of the slide member which enables the present invention to be used in applications where a larger "grip range" is desired; for example, where thicker gaskets are utilized the keeper is positioned at a greater distance from the fastener.

Another advantage of the present invention is that the position of the cam mechanism can be maintained within the device which improves both the durability and operation of the fastener over prior art devices. Specifically, in conventional fasteners the cam mechanism can be dislodged or otherwise tilted from its position within the opening of the sleeve member which creates several problems with the device. One problem is that damage of the components or possibly failure of the latch can occur due to a reduction in strength. Another drawback is that additional frictional resistance is created in the earn mechanism which makes it more difficult for an operator to rotate the device for latching or unlatching. The present invention insures that the cam mechanism will be retained in a planar relationship relative to the slide member so as to maintain the strength characteristics of the latch and provide a smooth latching and unlatching operation as the cam mechanism is rotated. In addition, the cam retaining feature of the present invention can be utilized with a variety of different cam arrangements, for example, those incorporating a single disc member or two or more disc members. In addition, the cam retaining feature of the present invention may be combined with the feature of increased "grip range" described above.

Another advantage of the present invention is that a novel cam arrangement is also provided which overcomes certain problems of conventional multiple disc cam arrangements. In particular, conventional multiple disc cam arrangements can separate when under load which may allow the portions to disconnect from one another and lead to failure of the device. The present invention provides an arrangement where an integral disc member of reduced parts is provided which is rotated to operate the device. This particular cam arrangement may also incorporate the cam retaining feature and/or feature of increased "grip range" noted above.

Another advantage of the present invention is that a fastener of compact design is provided which also provides a sufficient amount of latching force. In particular, in conventional fasteners a spring member can be incorporated within the design in order to provide an additional latching force in order to compensate for mounting inaccuracies and irregularities in the sealing surface or a gasket. However, in such conventional fasteners, the spring extends beyond the body of the fastener requiring a larger "footprint" area to affix the fastener to a panel. Accordingly, these types of devices have a drawback that they cannot be used where there is only a limited area in order to mount the latch. In addition, often times they are considered too "industrial looking" for use in many applications for this same reason. In the present invention, all of the features are confined within the latch structure which provides both a smaller latch design and also an aesthetically pleasing construction. In addition, in conventional devices the handle member is often times utilized in order to conceal the external spring member. The larger size of the handle member in these particular situations result with even larger devices. Further, the particular styling of the handle is limited to those designs which would conceal the external spring. However, in the present invention, the handle member may both be smaller in size and configured in any desired geometry since there is no external spring member which is needed to be concealed. Further, a sufficient amount of latching force is provided even though all of the features are confined within the body of the latch. Still another advantage is that the amount of spring force or spring rate produced by the present invention can be varied depending on either the physical geometry, material type or material hardness, which is not found in the prior art devices. Specifically, in conventional fasteners the spring rate is determined by the wire material and the geometry of a torsion loop, which limits the possible variations in spring force with such devices. Another advantage is that the spring member in the present invention is securely retained in the latch. However, in prior art devices, the spring can become disengaged from the latch due to the manner in which the spring is mounted. In addition, the connection of the sleeve member and base member by a pin improves the overall strength characteristics of the present invention. Another advantage is that the internal spring feature of the present invention may be combined with either one or any combination of the foregoing recited features of the present invention or any prior art devices.

It will be recognized by those skilled in the art that changes may be made by the above-described embodiments of the invention without departing from the broad and inventive concepts thereof. For example, the wing handle of the turning means recited above may be replaced by alternative wing shaped designs or alternative rotary members, such as a screw driver slot in the third disc member or a hex nut fastened on top of the third disc member. Another example of such a modification is that the base member may be recessed, as in U.S. Pat. No. 2,853,752 or have integral protective side flange portions. Another such example is that a modified slide member may be provided, as in U.S. Pat. No. 4,746,151. An example of still a further such modification is that an external wire spring, such as that shown in U.S. Pat. No. 2,820,995, may be incorporated within any of the foregoing embodiments of the present invention. It is understood, therefore, that this invention is not limited to the particular embodiments disclosed, but it is intending to cover all modifications which are within the scope and spirit of the invention as defined by the appended claims.

What is claimed is:

1. A fastener adapted to be secured to a first member for fastening a keeper secured to a second member, said fastener comprising:

a base member having opposing side portions, each side portion having a slot therein defined by a front end, a back end and a pair of generally elongated opposing connecting ends extending between the front end and the back end;

a sleeve member having therein an opening and opposed side portions forming a sleeve;

hinge means for pivotally connecting said base member and said sleeve member, said hinge means including attachment means received within the slots in the opposing side portions of said base member;

a slide member received within said sleeve of said sleeve member, to be extended or withdrawn, and having a cam opening;

cam means received within said opening of said sleeve member for rotatable movement therein;

a cam member extending from said cam means and protruding through said cam opening;

turning means for rotating said cam means to provide movement of said cam member within said cam opening for extending or withdrawing said slide member, whereby said slide member is adapted to latch said keeper as said slide member is withdrawn;

said latch further including means confined within said base member for biasing said sleeve member relative to said base member as said slide member is fastened with said keeper, wherein said attachment means is displaced along a longitudinal direction of said connecting ends of said slots and is closer to the front end of the slots of the base member when the slide member is fastened with said keeper than when the slide member is unfastened from said keeper.

2. A fastener according to claim 1, wherein said biasing means is confined between said side portions of said base member.

3. A fastener according to claim 2, wherein said biasing means comprises a torsion spring having at least one wound portion through which the hinge means passes.

4. A fastener according to claim 3, wherein said hinge means comprises a tubular portion of said sleeve member and the attachment means comprises a pivot pin extending through said tubular portion of said sleeve member and said slots of said base member, wherein said torsion spring comprises a double wound torsion spring through which said pivot pin passes and said tubular portion of said sleeve member is disposed between said wound portions of said torsion spring.

5. A fastener according to claim 3, wherein said base member includes a bottom portion connecting said opposing side portions, said bottom portion including means for securing said torsion spring.

6. A fastener according to claim 5, wherein said securing means comprises at least one raised boss engaging said torsion spring.

7. A fastener according to claim 6, wherein said securing means comprises a pair of raised bosses, each having a substantially annular portion.

8. A fastener according to claim 2, wherein said biasing means comprises an elastomer member engaging said hinge means.

9. A fastener according to claim 8, wherein said base member includes a bottom portion connecting said opposing side portions and including means for securing said elastomer member.

10. A fastener according to claim 9, wherein said securing means comprises at least one raised boss engaging said elastomer member.

11. A fastener according to claim 8, wherein said elastomer member includes at least one aperture through at least a portion thereof for receiving said hinge means.

12. A fastener according to claim 11, wherein said hinge means comprises a tubular portion of said sleeve member and a pivot pin extending through said tubular portion of said sleeve member and said side holes of said base member, wherein said elastomer member includes two protrusions at spaced separation, each of said protrusions including an aperture therethrough receiving said pivot pin, said tubular portion of said sleeve member being disposed between said protrusions of said elastomer member.

13. A fastener according to claim 12, wherein said base member includes a bottom portion connecting said opposing side portions and including means for securing said elastomer member.

14. A fastener according to claim 13, wherein said securing means comprises at least one raised boss engaging said elastomer member.

15. A fastener according to claim 2, wherein said base member includes a bottom portion connecting said opposing side portions, and said biasing means comprises at least one generally elongated resilient member extending from and integral with the bottom portion of the base member.

16. A fastener according to claim 2, wherein said base member includes a bottom portion connecting said opposing side portions, and said biasing means comprises a spring member received within a slot within the bottom portion of the base member.

17. An improved fastener of the type adapted to be secured to a first member for fastening a keeper secured to a second meter and comprising:

a base member;

a sleeve member pivotally connected to said base member, said sleeve member defining an upper surface and a lower surface having therein an opening and opposed side portions forming a sleeve;

a slide member received within said sleeve of said sleeve member, to be extended or withdrawn a predetermined amount, and having a cam opening;

cam means comprising at least one disc member received within said opening of said sleeve member for rotatable movement therein;

a cam member extending from said cam means protruding through said cam opening; and turning means for rotating said cam means to provide movement of said cam member within said cam opening for extending or withdrawing said slide member, said improvement comprising at least one tab proximate a perimeter of said at least one disc member, said tab defining two opposing ends extending from and transverse said perimeter and a connecting surface extending between the two ends at spaced separation from said perimeter.

18. An improved fastener according to claim 17, wherein said at least one tab comprises means for retaining said cam means within said opening of said sleeve member.

19. An improved fastener according to claim 18, wherein said at least one tab engages the lower surface of the sleeve member proximate the opening thereof comprising said retaining means.

20. An improved fastener according to claim 19, wherein said at least one tab is positioned at the perimeter of said at least one disc member and approximately 180° from a position of said hole relative to the perimeter of said disc member.

21. An improved fastener according to claim 19, further comprising at least two tabs, wherein a first tab is positioned at the perimeter of said at least one disc member and less than 180° from a position of said hole relative to the perimeter of said disc member, and a second tab is positioned at the perimeter of said at least one disc member and greater than 180° from a position of said hole relative to the perimeter of said disc member.

22. An improved fastener according to claim 17 further comprising means for increasing the predetermined amount of extension or withdrawal of said slide member.

23. An improved fastener according to claim 22, wherein said at least one disc member includes a hole therethrough, said hole being closer to a perimeter of said disc member than to the center of said disc member, said cam member including a generally elongated portion received within said hole of said disc member comprising said means for increasing the predetermined amount of extension or withdrawal of the slide member.

24. A fastener adapted to be secured to a first member for fastening a keeper secured to a second member, said fastener comprising:

a base member;

a sleeve member defining an upper surface and a lower surface having therein an opening and opposed side portions forming a sleeve;

hinge means pivotally connecting said base member and said sleeve member;

a slide member received within said opening of said sleeve member, to be extended or withdrawn, and having a cam opening;

cam means received within said opening of said sleeve member for rotatable movement therein;

a cam member extending from said cam means protruding through said cam opening;

turning means for rotating said cam means to provide movement of said cam member within said cam opening for extending or withdrawing said sleeve member;

said fastener further including means for retaining said cam means within said opening of said sleeve member as said cam means is rotated by said turning means, wherein said retaining means further comprises means for mounting said cam means in at least a first position in a direction from said upper surface to said lower surface of said sleeve member and in a second position in a direction from said lower surface to said upper surface of said sleeve member.

25. A fastener according to claim 24, wherein said retaining means comprises means for engaging the lower surface of the sleeve member proximate the opening thereof.

26. A fastener according to claim 25, wherein said cam means comprises at least one disc member received within said opening of said sleeve member and said engaging means comprises at least one area of increased diameter of said disc member.

27. A fastener according to claim 26, wherein said area of increased diameter of said disc member defines at least one tab extending a predetermined amount around the perimeter of said disc member and defining two opposing ends and a connecting surface extending between the two ends.

28. An improved fastener of the type adapted to be secured to a first member for a fastening a keeper secured to a second member comprising:

a base member;

a sleeve member defining an upper surface and a lower surface having therein an opening and opposed side portions forming a sleeve;

hinge means for pivotally connecting said base member and said sleeve member;

a slide member received within said sleeve of said sleeve member, to be extended or withdrawn a predetermined amount, and having a cam opening;

cam means received within said opening of said sleeve member for rotatable movement therein;

a cam member extending from said cam means protruding through said cam opening; and turning means for rotating said cam means to provide movement of said cam member within said cam opening for extending or withdrawing said slide member;

said improvement comprising:

means for increasing the predetermined amount of extension or withdrawal of the slide member;

means for retaining said cam means within said opening of said sleeve member comprising at least one tab proximate a perimeter of said cam means, said tab defining two opposing ends and a connecting surface extending between the two ends; and means confined within said base member for biasing said sleeve member relative to said base member as said slide member is fastened with said keeper, wherein said base member includes opposing side portions, each side portion having an opening therein defined by a front end, a back end and a pair of generally elongated opposing connecting ends extending between the front end and the back end, with said hinge means being disposed within said side openings of said base member, wherein said biasing means is confined between said side portions of said base member and said hinge means is moved within said openings of the base member along a longitudinal direction of said connecting ends and is closer to the front end of the openings of the base member when the slide member is fastened with said keeper than when the slide member is unfastened from said keeper.

29. An improved fastener according to claim 28, wherein said cam means comprises at least one disc member with said tab positioned at a perimeter thereof for engaging the lower surface of the sleeve member proximate the opening thereof comprising said retaining means.

30. An improved fastener according to claim 28, wherein said cam means comprises at least one disc member having a hole therethrough, said hole being closer to a perimeter of said disc member than to the center of said disc member, said cam member including a generally elongated portion received within said hole of said disc member comprising said means for increasing the predetermined amount of extension or withdrawal of the slide member.

31. A fastener according to claim 28, wherein said biasing means comprises a torsion spring having at least one wound portion through which the hinge means passes.

32. A fastener according to claim 28, wherein said base member includes a bottom portion connecting said opposing side portions, and said biasing means comprises at least one generally elongated resilient member extending from and integral with the bottom portion of the base member.

33. A fastener according to claim 28, wherein said base member includes a bottom portion connecting said opposing side portions, and said biasing means comprises a spring member received within a slot within the bottom portion of the base member.

34. A fastener according to claim 28, wherein said biasing means comprises an elastomer member engaging said hinge means.

35. A fastener according to claim 34, wherein said base member includes a bottom portion connecting said opposing side portions and including means for securing said elastomer member.

36. A fastener adapted to be secured to a first member for fastening a keeper secured to a second member, said fastener comprising:

a base member;

a sleeve member defining an upper surface and a lower surface having therein an opening and opposed side portions forming a sleeve;

hinge means for pivotally connecting said base member and said sleeve member;

a slide member received within said opening of said sleeve member, to be extended or withdrawn, and having a cam opening;

a first disc member having a hole therethrough and defining a lower disc and an upper disc, said lower disc being received within said opening of said sleeve member for rotatable movement therein and integrally connected to said upper disc defining a one-piece arrangement;

a second disc member having a hole therethrough;

a cam member extending through said holes in said first disc member and said second disc member for connecting said first and second disc members together, said cam member protruding through said cam opening;

turning means for rotating said first and second disc members to provide movement of said cam member within said cam opening for extending or withdrawing said sleeve member; and means for retaining said first disc member within said opening of said sleeve member as said first and second discs are rotated by said turning means, wherein said retaining means comprises means for engaging the upper surface and the lower surface of the sleeve member proximate the opening thereof, with said upper surface engaging means being at spaced separation from said lower surface engaging means with said sleeve member therebetween.

37. A fastener according to claim 36, wherein said upper and lower discs each are of a defined diameter, with at least a portion of said diameter of said upper disc being sized generally larger than said diameter of said lower disc, wherein said larger sized diameter of said upper disc defines a lower surface for engaging said upper surface of said sleeve member comprising said upper surface engaging means.

38. A fastener according to claim 37, wherein said lower surface engaging means comprises at least one area of increased diameter of said lower disc defining at least one tab extending a predetermined amount around the perimeter of said lower disc and defining two opposing ends and a connecting surface extending between the two ends.

39. A fastener according to claim 36, wherein said upper disc of said first disc member includes opposed side indentations and said turning means includes finger portions which fit in said indentations for turning said first and second disc members.

* * * * *

UNITED STATES PATENT AND TRADEMARK OFFICE

CERTIFICATE OF CORRECTION

PATENT NO. : 5,669,638

DATED : September 23, 1997

INVENTOR(S) : Glenn E. Anderson, et al.

It is certified that error appears in the above-identified patent and that said Letters Patent is hereby corrected as shown below:

Col. 9, line 57 "am" should be replaced with --are--.
Col. 12, line 46 "418A" should be deleted.
Col. 13, line 31 "am" should be replaced with --are--.
Col. 16, the last line, "meas" should be replaced with --means--.
Col. 18, line 11, "earn" should be replaced with --cam--.
Col. 21, in claim 17, line 3, "meter" should be replaced with --member--.

Signed and Sealed this

Sixth Day of October, 1998

*Attest:*

*Attesting Officer*

BRUCE LEHMAN

*Commissioner of Patents and Trademarks*